US006371724B2

(12) United States Patent
Nagaoka et al.

(10) Patent No.: US 6,371,724 B2
(45) Date of Patent: Apr. 16, 2002

(54) CENTRIFUGAL FLUID MACHINE

(75) Inventors: Yoshihiro Nagaoka, Ishioka; Sadashi Tanaka, Ibaraki-ken; Yukiji Iwase, Ushiku; Michiaki Ida, Tsuchiura; Hirotoshi Ishimaru, Ibaraki-ken; Saburo Iwasaki, Tsuchiura; Yoshiharu Ueyama, Tsukuba; Tetuya Yoshida, Tsuchiura, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/862,313

(22) Filed: May 23, 2001

Related U.S. Application Data

(62) Division of application No. 09/534,085, filed on Mar. 23, 2000, which is a division of application No. 09/391,090, filed on Sep. 16, 1999, now Pat. No. 6,139,266, which is a division of application No. 09/179,858, filed on Oct. 28, 1998, now Pat. No. 5,971,705, which is a division of application No. 08/741,688, filed on Oct. 31, 1996, now Pat. No. 5,857,834, which is a continuation of application No. 08/324,212, filed on Oct. 17, 1994, now Pat. No. 5,595,473.

(30) Foreign Application Priority Data

Oct. 18, 1993 (JP) ..... 5-259609
Dec. 17, 1993 (JP) ..... 5-317711

(51) Int. Cl.[7] ..... F04D 29/44
(52) U.S. Cl. ..... 415/208.3; 416/208.1
(58) Field of Search ..... 415/199.1, 208.1, 415/208.3; 416/223 B

(56) References Cited

U.S. PATENT DOCUMENTS 1,369,527 A 2/1921 Johnston
1,456,906 A 5/1923 Noland (List continued on next page.)

FOREIGN PATENT DOCUMENTS

CN 1040073 2/1990
DE 4313617 5/1994
EP 0526965 2/1993

(List continued on next page.)

OTHER PUBLICATIONS

Patent Abstracts of Japan vol. 010, No. 378 (M–546) Dec. 17, 1986 & JP 61 169696 A (Bobe Steel) Jul. 31, 1986—Abstract.

Patent Abstracts of Japan vol. 011, No. 183 (M–598) Jun. 12, 1987 & JP 62 010495 A (Matsushita Electric Ind. Co., Ltd.) Jan. 19, 1987.

Patent Abstracts of Japan vol. 16, No. 158 (M–1288) Jul. 30, 1992 & JP 01 109098 (Mitsubishi Electric) Apr. 10, 1992—abstract.

Patent Abstracts of Japan vol. 004, No. 158 (M–039) Nov. 5, 1980 & JP 55 107099 A (Matsushita Electric) Aug. 16, 1980—abstract.

*Primary Examiner*—John Kwon
(74) *Attorney, Agent, or Firm*—Antonelli, Terry, Stout & Kraus, LLP

(57) ABSTRACT

At a vaned diffuser or a volute casing of a centrifugal fluid machine, pressure pulsation and vibrating forces acting upon the diffuser or the volute casing are mitigated or cancelled so as to abate the noise from the centrifugal fluid machine. The fluid machine having an impeller 3 rotating about a rotating shaft 2 within a casing 1 and having a vaned diffuser 4 or volute 12 fixed to the casing 1 is constructed such that radius of the vane trailing edge of the impeller 3 and radius of the vane leading edge of the diffuser 4 or radius of the volute tongue is varied in the direction of axis of rotation and inclinations, on a meridional plane, of the vane trailing edge of the impeller 3 and the vane leading edge of the diffuser 4 or the volute tongue are set in the same orientation, thereby reduction in head and efficiency or occurrence of an axial thrust may be restrained to the extent possible to optimally abate the noise and pressure pulsation of the centrifugal fluid machine.

1 Claim, 23 Drawing Sheets

U.S. PATENT DOCUMENTS

| | | | | | |
|---|---|---|---|---|---|
| 1,822,945 | A | | 9/1931 | Weis | |
| 2,160,666 | A | | 5/1939 | McMahan | |
| 2,273,420 | A | | 2/1942 | Schott | |
| 2,362,514 | A | | 11/1944 | Warner | |
| 2,854,926 | A | | 10/1958 | Haight | |
| 2,973,716 | A | | 3/1961 | Thomas | |
| 3,506,373 | A | | 4/1970 | Danker | |
| 3,628,881 | A | | 12/1971 | Herrmann, Jr. | |
| 3,778,186 | A | | 12/1973 | Bandukwalla | |
| 3,861,825 | A | | 1/1975 | Blom | |
| 4,027,994 | A | | 6/1977 | Macinnes | |
| 4,076,450 | A | | 2/1978 | Ross | |
| 4,371,310 | A | | 2/1983 | Henry, IV | |
| 4,781,531 | A | | 11/1988 | James | |
| 5,228,832 | A | | 7/1993 | Nishida | |
| 5,310,309 | A | | 5/1994 | Terasaki et al. | |
| 5,595,473 | A | | 1/1997 | Nagaoka | |
| 5,857,834 | A | | 1/1999 | Nagaoka et al. | |
| 5,971,705 | A | | 10/1999 | Nagaoka et al. | |
| 6,139,266 | A | * | 10/2000 | Nagaoka et al. | 415/208.3 |
| 6,290,460 | B1 | * | 9/2001 | Nagaoka et al. | 415/208.2 |
| 6,312,222 | B1 | * | 11/2001 | Nagaoka et al. | 415/208.3 |

FOREIGN PATENT DOCUMENTS

| | | |
|---|---|---|
| FR | 352787 | 8/1905 |
| FR | 361986 | 1/1907 |
| FR | 1091307 | 1/1954 |
| GB | 112292 | 12/1917 |
| GB | 636290 | 4/1950 |
| JP | 231199 | 12/1984 |
| WO | 9113259 | 9/1991 |
| WO | 9310358 | 5/1993 |

* cited by examiner

CENTRIFUGAL FLUID MACHINE

This is a divisional application of U.S. patent application Ser. No. 09/534,085, filed Mar. 23, 2000, which is a divisional application of U.S. patent application Ser. No. 09/391,090, filed Sep. 16, 1999, now U.S. Pat. No. 6,139,266, which is a divisional application of U.S. patent application Ser. No. 09/179,858, filed Oct. 28, 1998 (U.S. Pat. No. 5,971,705), which is a divisional application of U.S. patent application Ser. No. 08/741,688, filed Oct. 31, 1996 (U.S. Pat. No. 5,857,834), which is a continuation application of U.S. patent application Ser. No. 08/324,212, filed Oct. 17, 1994 (U.S. Pat. No. 5,595,473).

FIELD OF THE INVENTION

The present invention relates to centrifugal fluid machines such as a pump or compressor and, more particularly, relates to a centrifugal fluid machine in which noise and pressure pulsation may be suitably abated.

DESCRIPTION OF THE PRIOR ART

A flow distribution which is not uniform in the peripheral direction occurs at the outlet of an impeller due to the thickness of a vane and secondary flow or boundary layer occurring between the vanes. Such nonuniform pulsating flow interferes with the leading edge of the vanes of a diffuser or a volute tongue, resulting in a periodical pressure pulsation and causing a noise. In some cases, such pressure pulsation vibrates the diffuser and furthermore vibrates a casing or an outer casing outside thereof through a fitting portion, whereby the vibration is propagated into the air surrounding the pump to cause a noise.

In a centrifugal pump as disclosed in Zulzer Technical Review Vol. 62 No.1 (1980) PP.24–26, the noise is reduced by varying radius of the trailing edge of vanes of the impeller or the peripheral position of the trailing edge of the vanes in the direction of axis of rotation. Further, in an electric fan as disclosed in Japanese Patent Laid-Open Publication No. 51-91006, a pressure increasing section and a noise abatement section (the noise abatement section being the portion where the peripheral position of a volute tongue is varied in the direction of axis of rotation) are formed on the volute wall of a volute casing and the peripheral distance of the noise abatement section is made substantially equal to the peripheral distance between the trailing edges of the vanes that are next to each other in the impeller, so that the flow from the impeller does not impact the volute tongue all at once. In this manner, a shift in phase in the direction of axis of rotation occurs in the interference between the flow and the volute tongue, whereby the periodical pressure pulsation is mitigated to lead to an abatement of the noise.

In the above prior art, however, there has been a problem that, when radius of the trailing edge of the vane of the impeller is varied in the direction of axis of rotation, the head or the efficiency thereof is reduced due to the fact that the ratio between radius of the trailing edge of the impeller vane and radius of the leading edge of the diffuser vane or radius of the volute tongue is varied in the direction of axis of rotation. Further, when the outer radius of the main shroud and the front shroud of the impeller are different from each other in association with the fact that the trailing edge radius of the impeller vane is varied in the direction of axis of rotation, an axial thrust occurs due to difference between the projected areas of the main shroud and the front shroud in the direction of axis of rotation. In the case where the peripheral position of the trailing edge of the impeller vane is varied in the direction of axis of rotation, although the peripheral distance between the trailing edge of the impeller vane and the leading edge of the diffuser vane or the volute tongue is varied, amount of such change has not been optimized. In the case where the peripheral position of the volute tongue is varied in the direction of axis of rotation and amount in such change is substantially equal to the peripheral distance between the trailing edges of the impeller vanes which are next to each other, the portion for effecting the pressure recovery in the volute casing becomes shorter where a sufficient pressure recovery cannot be obtained.

An object of the present invention is to provide a centrifugal fluid machine in which reduction in head and efficiency or occurrence of an axial thrust is controlled while noise and pressure pulsation are abated.

SUMMARY OF THE INVENTION

In the case of a diffuser pump, the above object may be achieved such that the trailing edge radius of the impeller vane and the leading edge radius of the diffuser vane are increased or decreased monotonously in the direction of axis of rotation and inclinations on a meridional plane of the trailing edge of the impeller and the leading edge of the diffuser are in the same orientation.

Alternatively, it may be achieved such that, of the trailing edge of the impeller vane, radius at the center in the direction of axis of rotation is made larger than radius at the two ends in the direction of axis of rotation and, of the leading edge of the diffuser vane, radius at the center in the direction of axis of rotation is made larger than radius at the two ends in the direction of axis of rotation.

Alternatively, it may be achieved such that, of the trailing edge of the impeller vane, radius at the center in the direction of axis of rotation is made smaller than radius at the two ends in the direction of axis of rotation and, of the leading edge of the diffuser vane, radius at the center in the direction of axis of rotation is made smaller than radius at the two ends in the direction of axis of rotation.

Alternatively, it may be achieved such that the trailing edge radius of the impeller vane and the leading edge radius of the diffuser vane are varied in the direction of axis of rotation and the ratio between the trailing edge radius of the impeller vane and the leading edge radius of the diffuser vane is made constant in the direction of axis of rotation.

Alternatively, it may be achieved such that the peripheral distance between the trailing edge of the impeller vane and the leading edge of the diffuser vane is varied in the direction of axis of rotation and difference between the maximum value and the minimum value of the peripheral distance between the trailing edge of the impeller vane and the leading edge of the diffuser vane is made equal to the peripheral distance between the trailing edges of the vanes next to each other in the impeller or to a part obtained by equally dividing that by an integer.

Alternatively, it may be achieved such that, when the leading edge of the diffuser vane and the trailing edge of the impeller vane are projected onto a circular cylindrical development of the diffuser leading edge, the leading edge and the trailing edge of the vanes are perpendicular to each other on the circular cylindrical development.

In the case of a volute pump, the above object may be achieved such that the trailing edge radius of the impeller vane and radius of the volute tongue of the volute casing are increased or decreased monotonously in the direction of axis of rotation and inclinations on a meridional plane of the trailing edge of the impeller vane and the volute tongue are set in the same orientation.

Alternatively, it may be achieved such that, of the trailing edge of the impeller vane, radius at the center in the direction of axis of rotation is made larger than radius at the two ends in the direction of axis of rotation and, of the volute tongue of the volute casing, radius at the center in the direction of axis of rotation is made larger than radius at the two ends in the direction of axis of rotation.

Alternatively, it may be achieved such that, of the trailing edge of the impeller vane, radius at the center in the direction of axis of rotation is made smaller than radius at the two ends in the direction of axis of rotation and, of the volute tongue of the volute casing, radius at the center in the direction of axis of rotation is made smaller than radius at the two ends in the direction of axis of rotation.

Alternatively, it may be achieved such that the trailing edge radius of the impeller vane and the radius of the volute tongue of the volute casing are varied in the direction of axis of rotation and the ratio between the trailing edge radius of the impeller vane and the radius of the volute tongue is made constant in the direction of axis of rotation.

Alternatively, it may be achieved such that the peripheral position of the trailing edge of the impeller vane is varied in the direction of axis of rotation and difference between the maximum value and the minimum value of the peripheral distance between the trailing edge of the impeller vane and the volute tongue is made equal to the peripheral distance between trailing edges of the vanes that are next to each other in the impeller or to a part obtained by equally dividing that by an integer.

Alternatively, it may be achieved such that, when the volute tongue of the volute casing and the trailing edge of the impeller vane are projected onto a circular cylindrical development of the volute tongue, the volute tongue and the trailing edge of the vane are perpendicular to each other on the circular cylindrical development.

In the case of a multistage centrifugal fluid machine, the above object may be achieved such that, for at least two impellers of the impellers of the respective stages each constituted by a main shroud, a front shroud and vanes, the trailing edge radius of the vane is varied in the direction of axis of rotation and the main shroud and the front shroud are formed into different radiuses; of the impellers of which the main shroud and the front shroud are formed into different radiuses, the outer radius of the main shroud of at least one impeller is made larger than the front shroud thereof and the main shroud of the remaining impellers is made smaller than the front shroud thereof.

Alternatively it may be achieved such that, for an even number of impellers of the impellers of the respective stages each constituted by a main shroud, a front shroud and vanes, the trailing edge radius of the vane is varied in the direction of axis of rotation and the main shroud and the front shroud are formed into different radiuses of the impellers of which the main shroud and the front shroud are formed into different radiuses, the main shroud of one half of the impellers is made larger than the front shroud thereof and the main shroud of the remaining half of the impellers is made smaller than the front shroud thereof.

DESCRIPTION OF THE PREFERRED EMBODIMENTS

Figure 1:
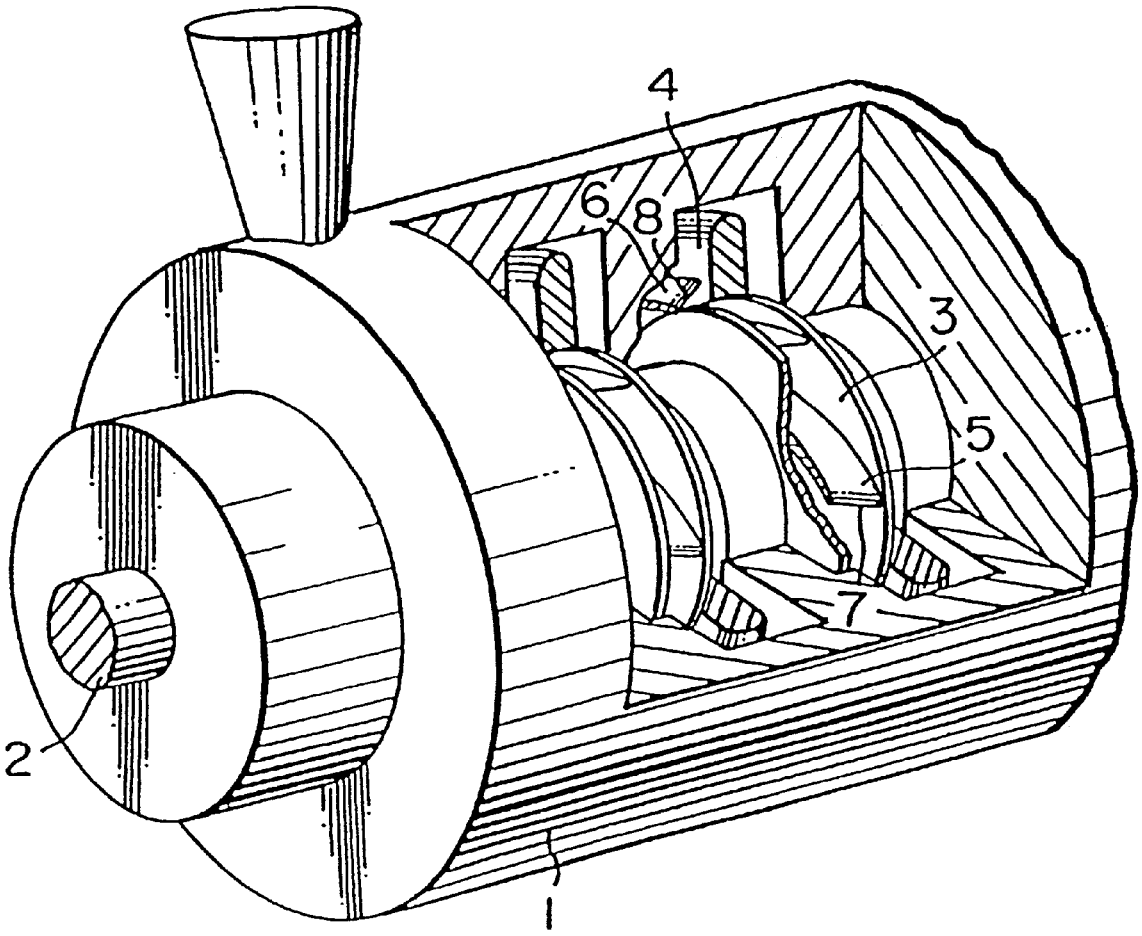
FIG. 1 is a sectional perspective view of a diffuser pump showing an embodiment of the present invention.
Figure 2:
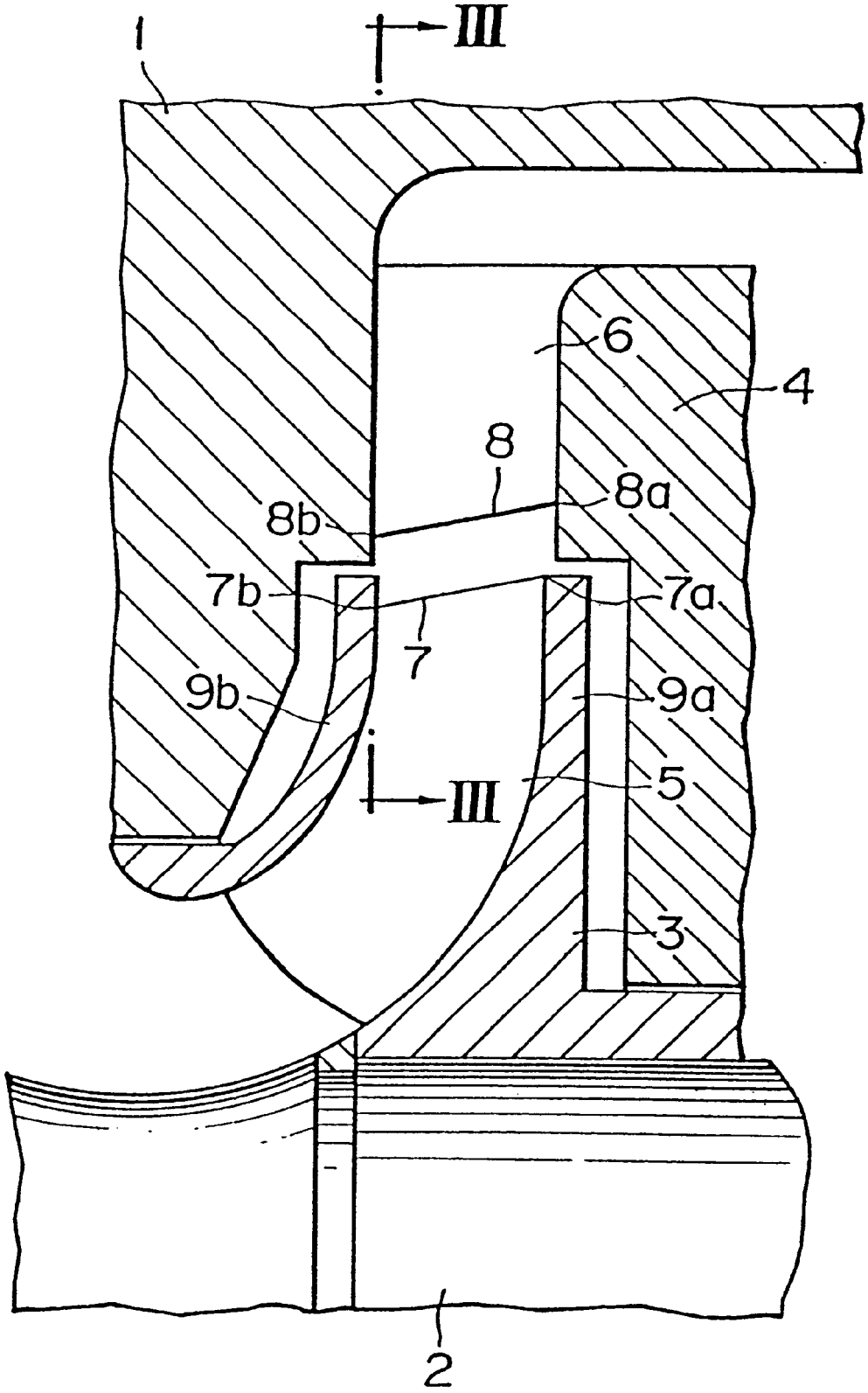
FIG. 2 is a sectional view of a diffuser pump showing an embodiment of the present invention.
Figure 3:
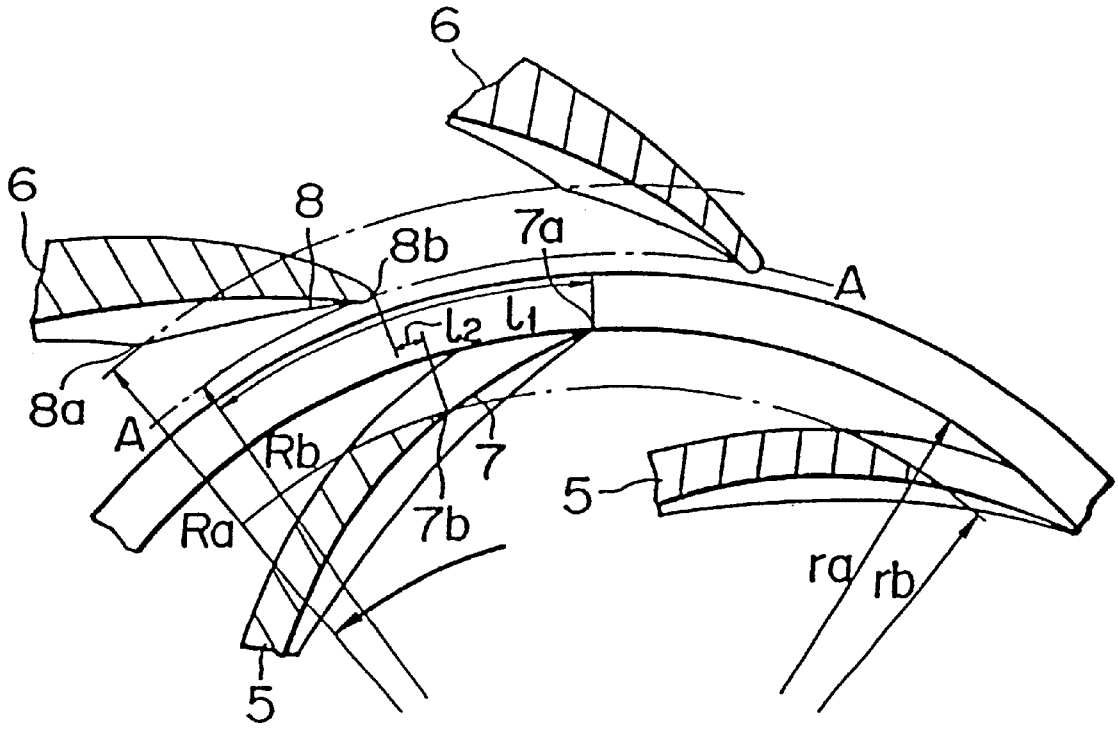
FIG. 3 is a detailed front sectional view taken along section III—III of FIG. 2.
Figure 4:
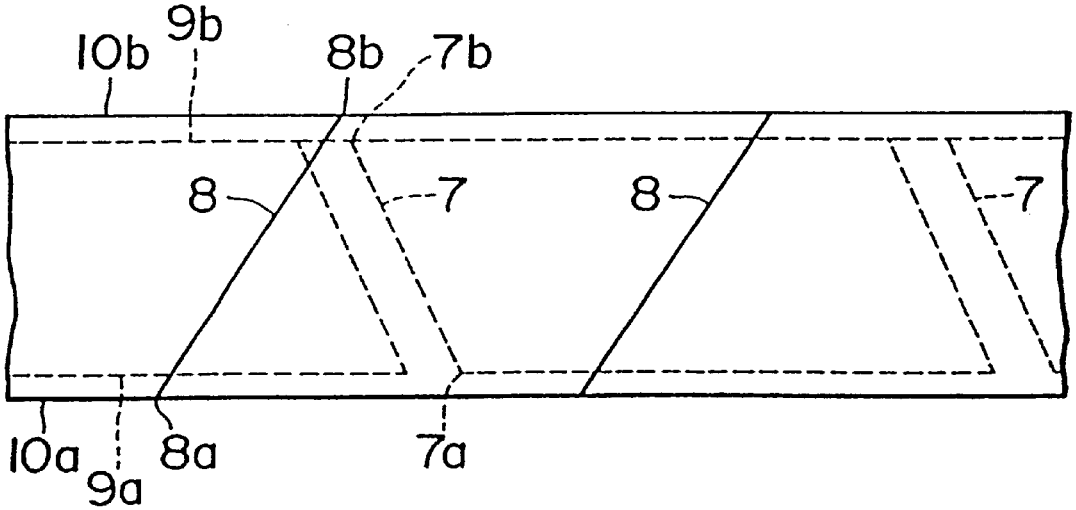
FIG. 4 is a development obtained by projecting the trailing edge of the impeller vane and the leading edge of the diffuser vane onto A—A circular cylindrical section of FIG. 3.
Figure 5:
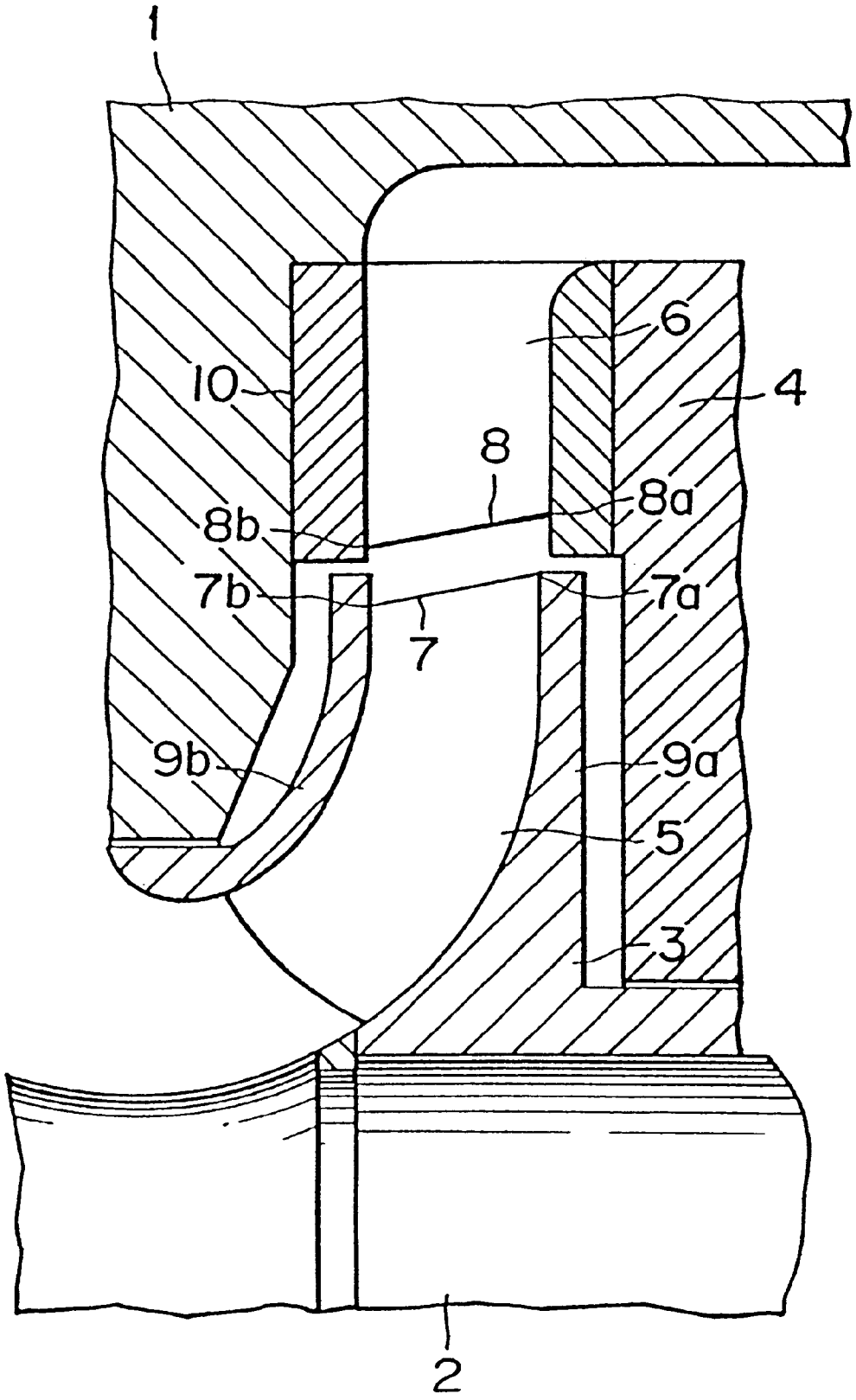
FIG. 5 is a sectional view of a diffuser pump showing an embodiment of the present invention.
Figure 6:
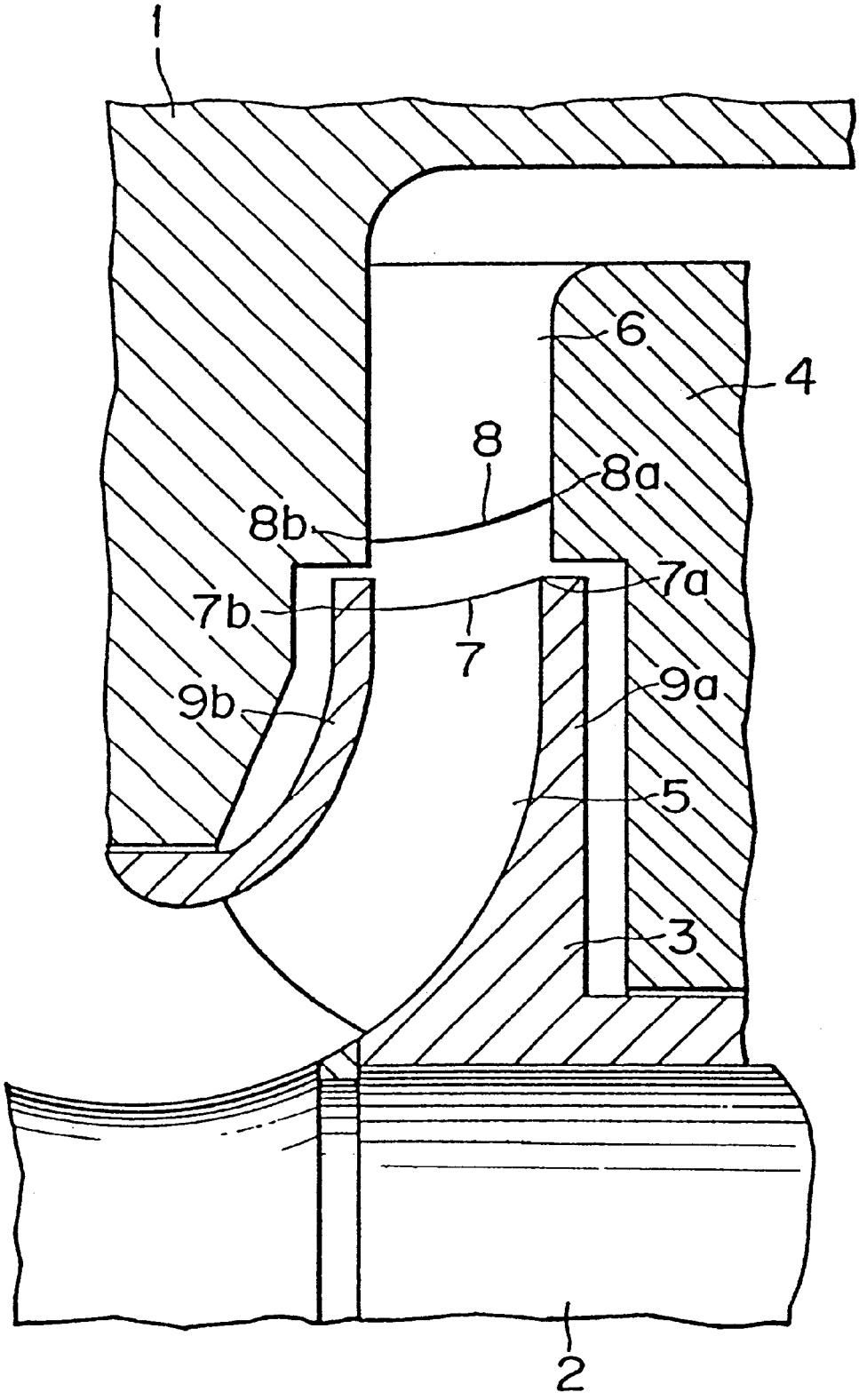
FIG. 6 is a sectional view of a diffuser pump showing an embodiment of the present invention.

An embodiment 1 of the present invention will now be described by way of FIG. 1. An impeller 3 is rotated about a rotating shaft 2 within a casing 1, and a diffuser 4 is fixed to the casing 1. The impeller 3 has a plurality of vanes 5 and the diffuser 4 has a plurality of vanes 6, where a trailing edge 7 of the vane 5 of the impeller 3 and a leading edge 8 of the vane 6 of the diffuser 4 are formed so that their radius is varied, respectively, along the axis of rotation. FIG. 2 shows shapes on a meridional plane of a pair of impeller and diffuser as shown in FIG. 1. The vane trailing edge 7 of the impeller 3 has its maximum radius at a side 7*a* toward a main shroud 9*a* and has its minimum radius at a side 7*b* toward a front shroud 9*b*. The vane leading edge 8 of the diffuser 4 is also inclined on the meridional plane in the same orientation as the vane trailing edge 7 of the impeller 3, and it has its maximum radius at a side 8*a* toward the main shroud 9*a* and its minimum radius at a side 8*b* toward the front shroud 9*b*. FIG. 3 shows in detail the vicinity of the impeller vane trailing edge 7 and the diffuser vane leading edge 8 of a section along line III—III of FIG. 2. The impeller vane 5 and the diffuser vane 6 are of three-dimensional shape, i.e., the peripheral positions of the vanes are varied in the direction of axis of rotation and radius of the impeller vane trailing edge 7 and radius of the diffuser vane leading edge 8 are varied in the direction of axis of rotation, so as to vary the peripheral position of the impeller vane trailing edge 7 and the diffuser vane leading edge 8 in the direction of axis of rotation. The relative position in the peripheral direction between the impeller vane trailing edge 7 and the diffuser vane leading edge 8 of FIG. 4 is shown in FIG. 4. FIG. 4 is obtained by projecting the impeller vane trailing edge 7 and the diffuser vane leading edge 8 onto a circular cylindrical development of the diffuser vane leading edge. In other words, of FIG. 3, the impeller vane trailing edge 7 and the diffuser vane leading edge 8 as seen from the center of the rotating shaft are projected onto the cylindrical cross section A—A and it is developed into a plane. This is because in turbo fluid machines, a vane orientation is opposite between a rotating impeller and a stationary diffuser as viewed in a flow direction. By providing the inclinations, on a meridional plane, of the diffuser vane leading edge 8 and the impeller vane trailing edge 7 in the same orientation, a shift occurs in the peripheral position between the impeller vane trailing edge 7 and the diffuser vane leading edge 8. Due to such shift in the peripheral direction, the pulsating flow flowing out from the impeller vane trailing edge 7 impacts the diffuser vane leading edge 8 with a shift in phase so that the pressure pulsation is mitigated. Further, if the diffuser 4 is fixed to the casing 1 through a fitting portion 10 as shown in FIG. 5, vibration of the diffuser 4 vibrated by the pressure pulsation propagates to the casing 1 through the fitting portion 10 and vibrates the surrounding air to cause a noise; thus, the noise is abated when the pressure pulsation acting upon the diffuser vane leading edge 8 is mitigated according to the present embodiment.

Figure 7:
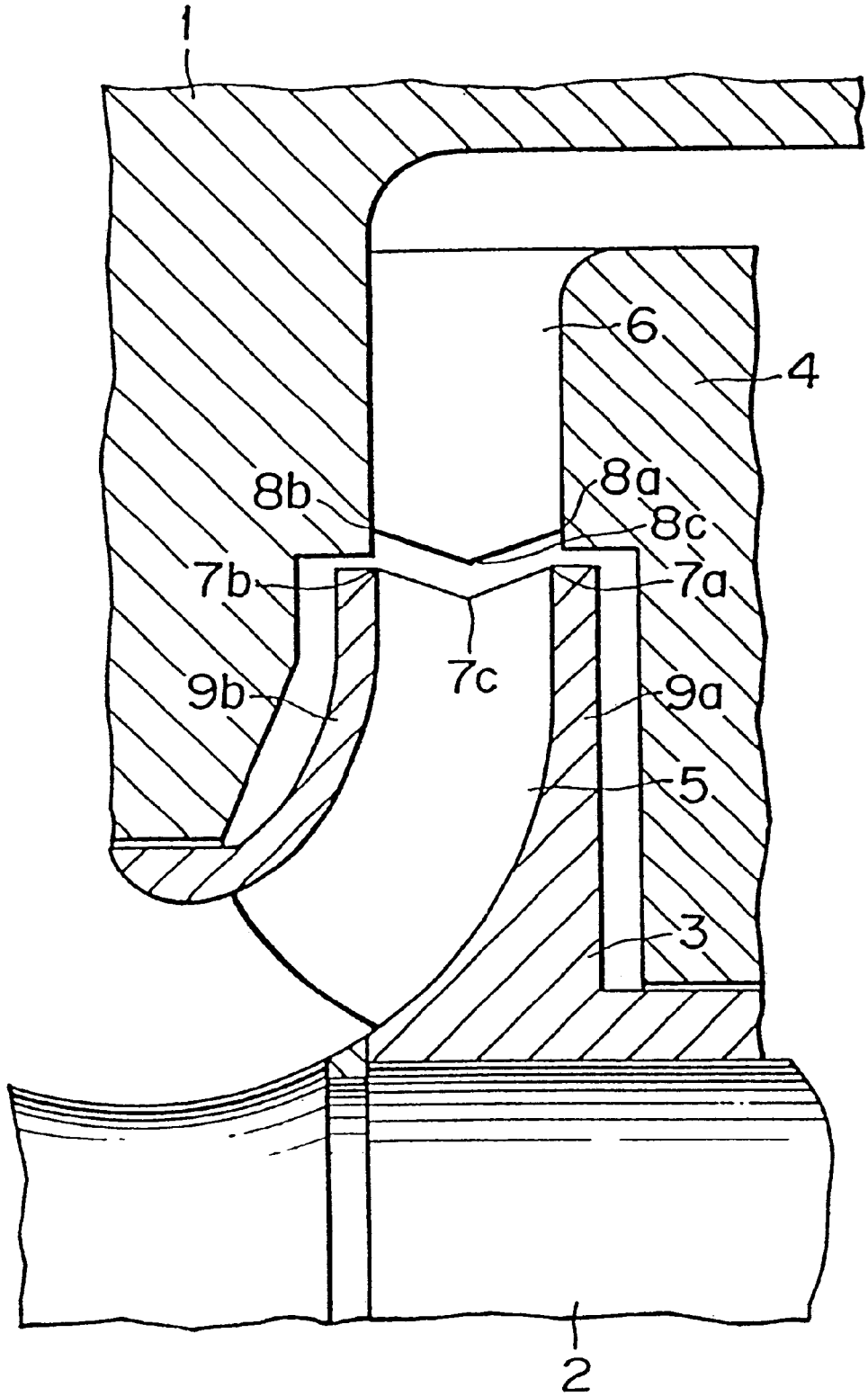
FIG. 7 is a sectional view of a diffuser pump showing an embodiment of the present invention.
Figure 8:
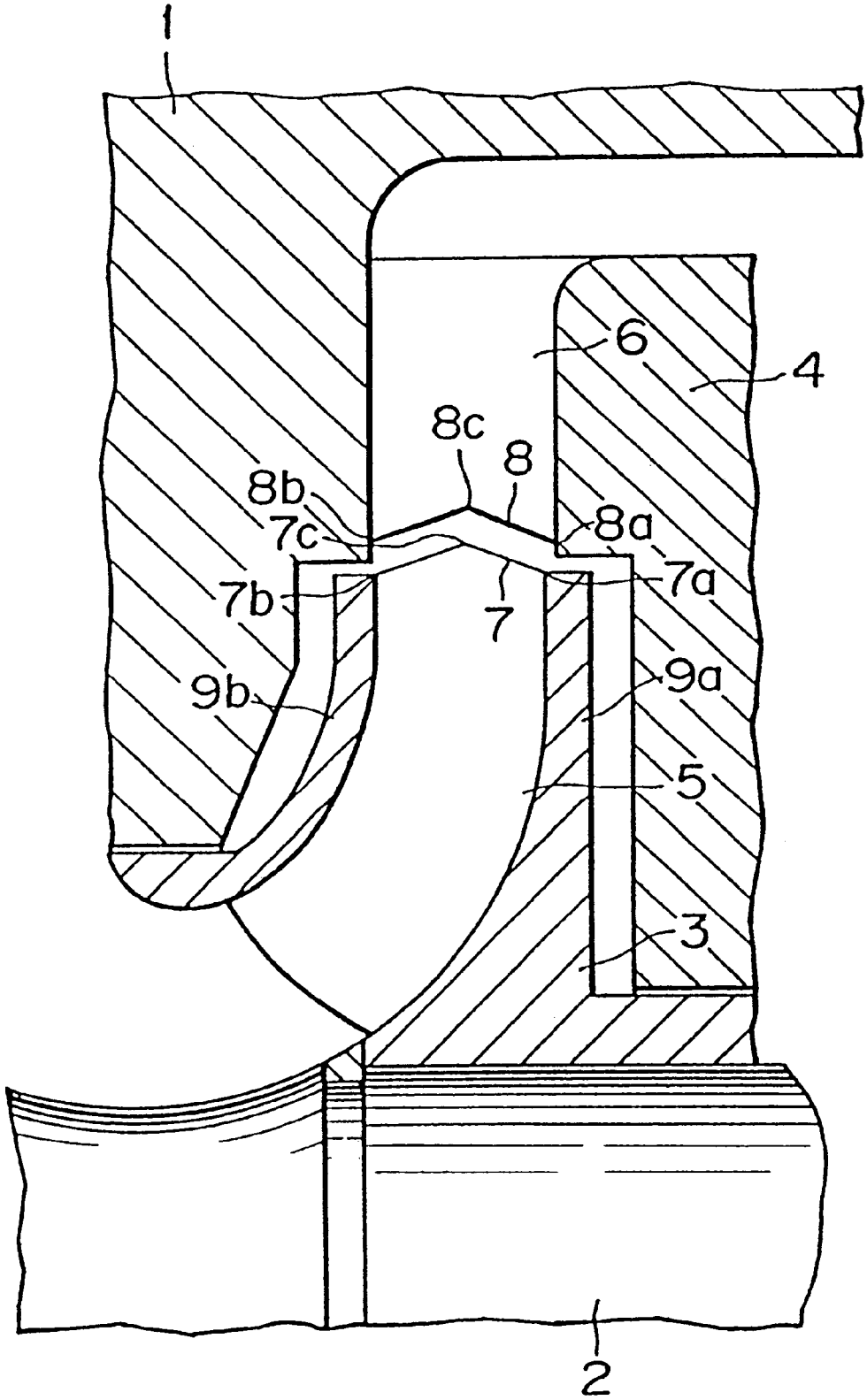
FIG. 8 is a sectional view of a diffuser pump showing an embodiment of the present invention.

In the embodiment as shown in FIG. 2, the shape on the impeller vane trailing edge 7 and the diffuser vane leading edge 8 on a meridional plane is a straight line. In general, however, it suffices that radius of the impeller vane trailing edge 7 and radius of the diffuser vane leading edge 8 are monotonously increased or decreased in the direction of axis of rotation and inclinations of the impeller vane trailing edge 7 and that the diffuser vane leading edge 8 on a meridional plane are inclined in the same orientation. Further, it is also possible that, as shown in FIG. 7 or FIG. 8, of the impeller vane trailing edge 7, radius at the center 7*c* in the direction of axis of rotation is made larger or smaller than the radius at the two ends 7*a*, 7*b* in the direction of the axis of rotation and, of the diffuser vane leading edge 8, radius at the center 8*c* in the direction of axis of rotation is made larger or smaller than radius at the two ends 8*a*, 8*b* in the direction of axis of rotation.

Figure 9:
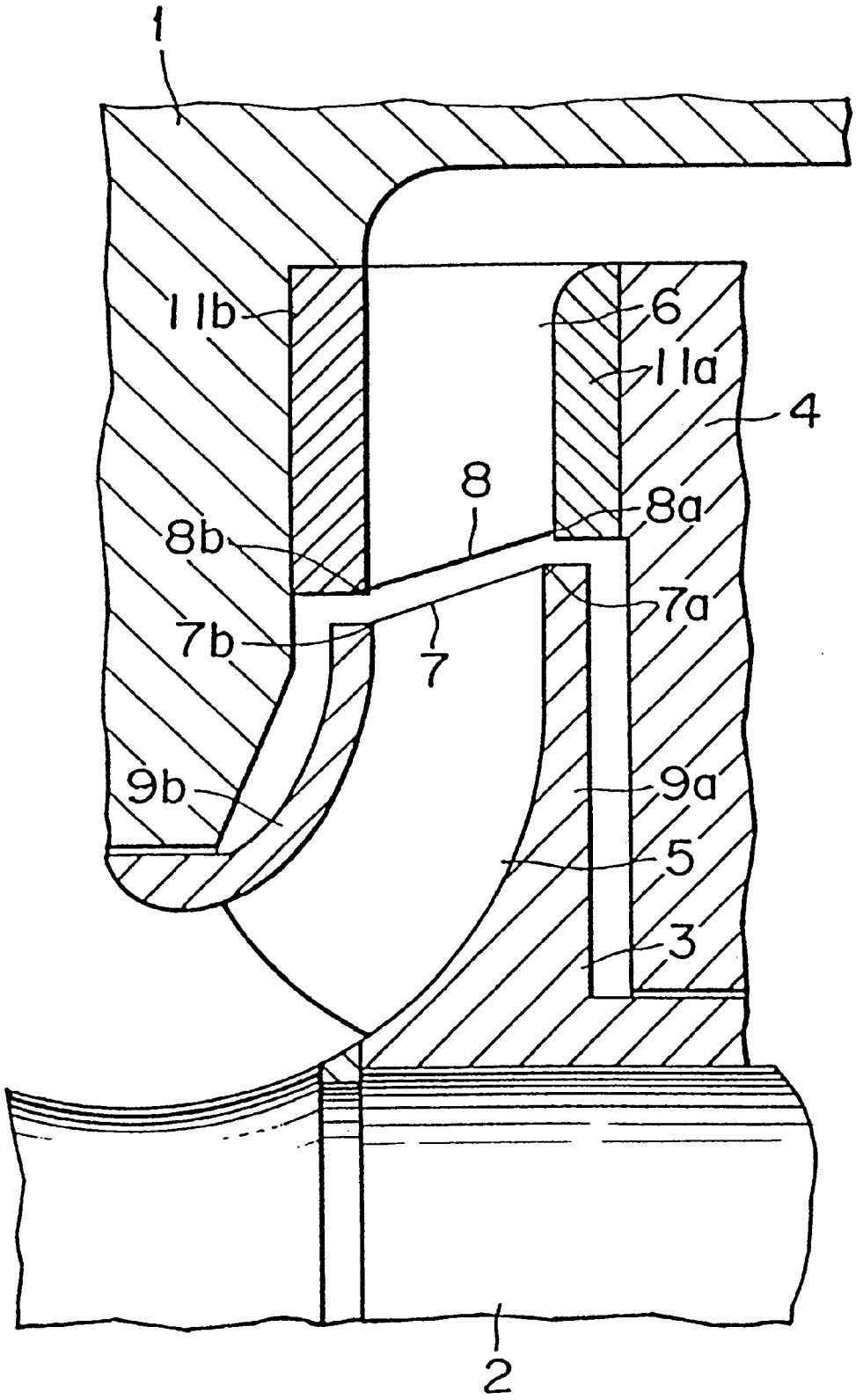
FIG. 9 is a sectional view of a diffuser pump showing an embodiment of the present invention.
Figure 10:
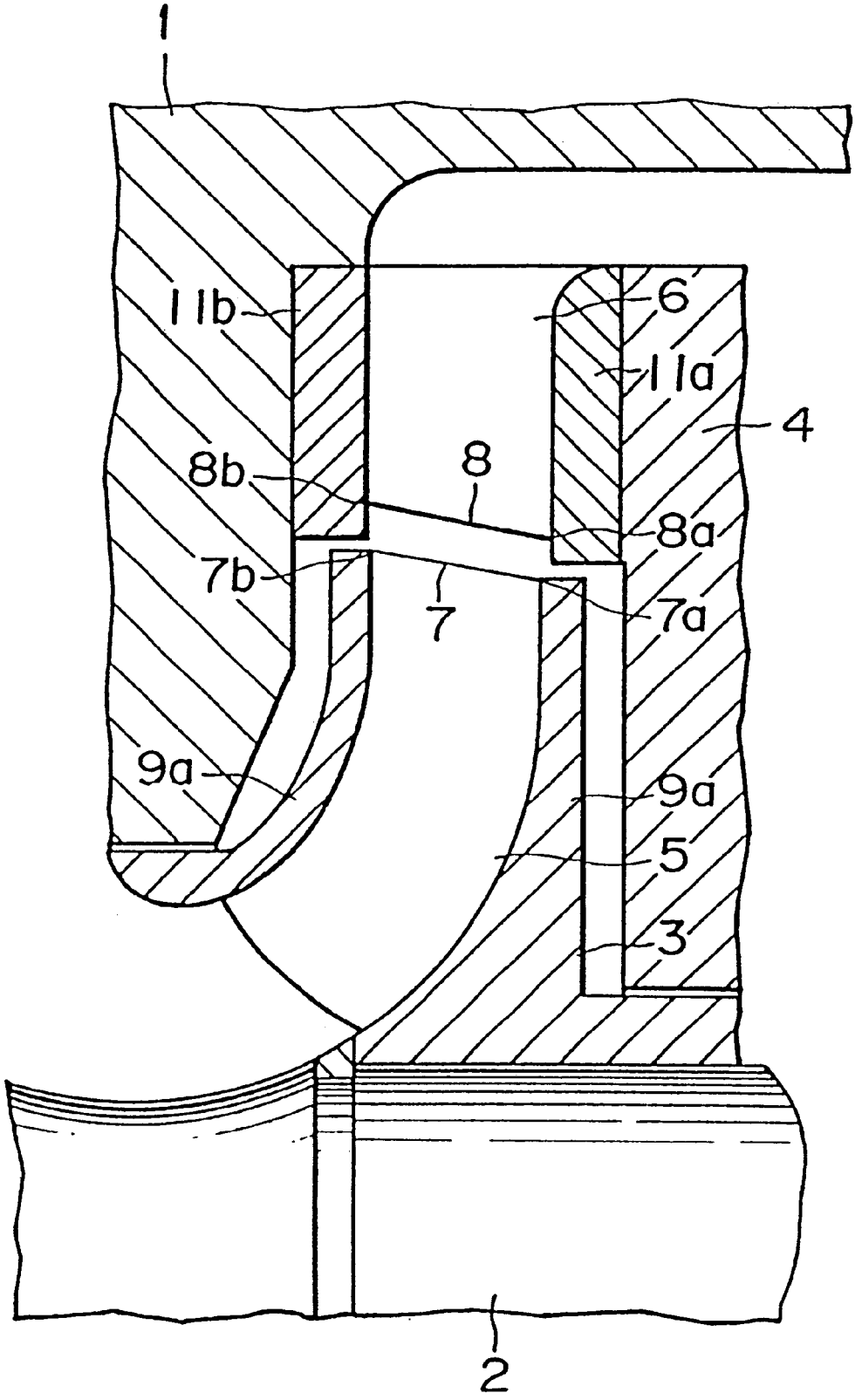
FIG. 10 is a sectional view of a diffuser pump showing an embodiment of the present invention.

Further, in the present embodiment shown in FIG. 2, outer diameters of the main shroud 9*a* and the front shroud 9*b* of the impeller 3 are, as shown in FIG. 9, not required to be equal to each other and the inner diameters of the front shrouds 11*a*, 11*b* of the diffuser are not required to be equal to each other. By constructing in this manner, ratio of the radiuses between the impeller vane trailing edge 7 and the diffuser vane leading edge 8 may be of the conventional construction, so that degradation in performance such as of head or efficiency due to an increase in the ratio of the radius of the diffuser vane leading edge to the radius of the impeller vane trailing edge does not occur. More preferably, as shown in FIG. 10, by making the outer diameter of the main shroud 9*a* of the impeller 3 smaller than the outer diameter of the front shroud 9*b*, the vane length of the impeller may be made uniform from the main shroud 9*a* side to the front shroud 9*b* side, so that the projected area in the direction of axis of rotation of the main shroud 9*a* on the high pressure side may be reduced with respect to the projected area of the front shroud 9*b* on the low pressure side so as to abate the axial thrust thereof.

Further, as shown in FIG. 3, ratio ($R_a/r_a$) of radius $R_a$ of the outermost periphery portion 8*a* of the diffuser vane leading edge 8 to radius $r_a$ of the outermost periphery portion 7*a* of the impeller vane trailing edge 7 is set to the same as ratio ($R_b/r_b$) of radius $R_b$ of the innermost periphery portion 8*b* of the diffuser vane leading edge 8 to radius $r_b$ to the innermost periphery portion 7*b* of the impeller vane trailing edge 7, and the ratio of the radius of the impeller vane trailing edge to the radius of the diffuser vane leading edge is made constant in the axial direction, thereby degradation in performance may be controlled to a minimum.

As shown in FIGS. 2, 3, 5, 9 and 10, when the ratio between the trailing edge radius of the impeller and the leading edge radius of the diffuser vane is constant in the direction of axis of rotation, an efficient characteristics for a region of small flow rate is obtained.

Figure 11:
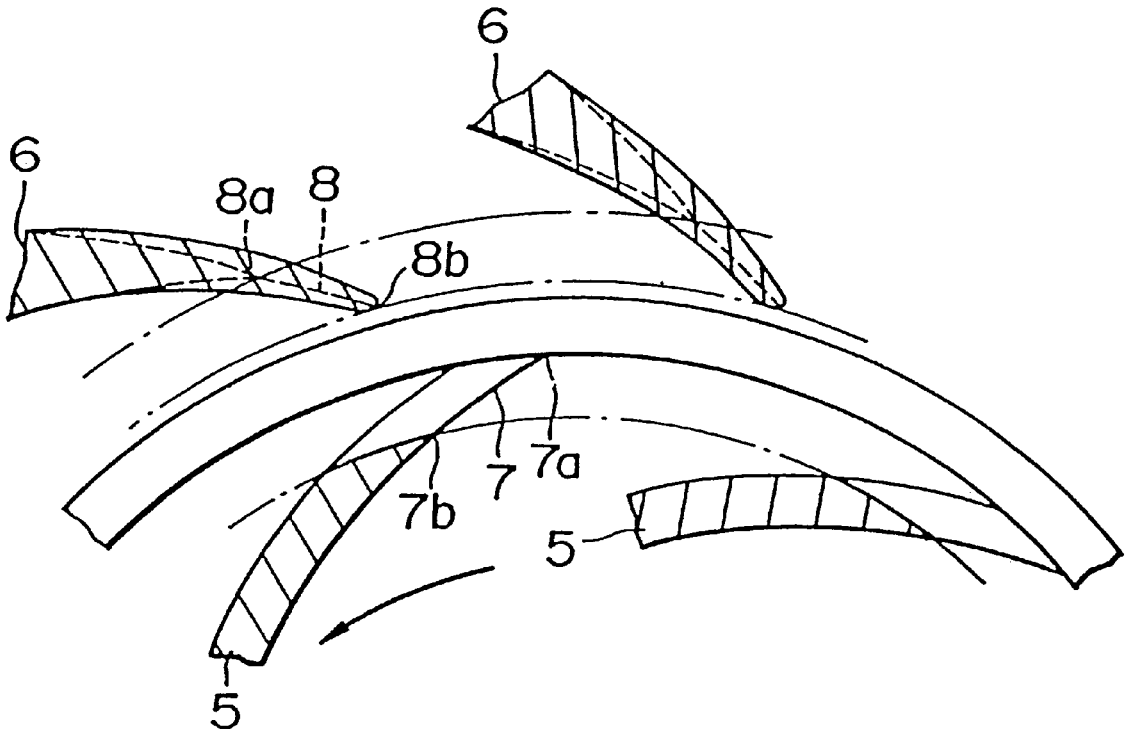
FIG. 11 is a detailed front sectional view of a diffuser pump showing an embodiment of the present invention.

Further, FIG. 11 illustrates in detail a case where the impeller vane 5 and the diffuser vane 6 are two-dimensionally designed. In FIG. 11, vanes 5 and 6 are two-dimensionally shaped, i.e., the peripheral position of the vane is constant in the direction of axis of rotation; however, by varying radius of the impeller vane trailing edge 7 and radius of the diffuser vane leading edge 8 in the direction of axis of rotation, the peripheral positions of the impeller vane trailing edge 7 and the diffuser vane leading edge 8 are changed in the direction of axis of rotation. For this reason, the pulsating flow impacts on the diffuser with a shift in phase so that force for vibrating the diffuser is reduced to abate the noise. Specifically, by forming the vanes into a two-dimensional shape, diffusion joining and forming of a press steel sheet thereof become easier and workability, precision and strength of the vane may be improved.

The present invention as shown in FIG. 2 or FIG. 5 may be applied to a centrifugal pump or centrifugal compressor irrespective of whether it is of a single stage or of a multistage type.

Figure 12:
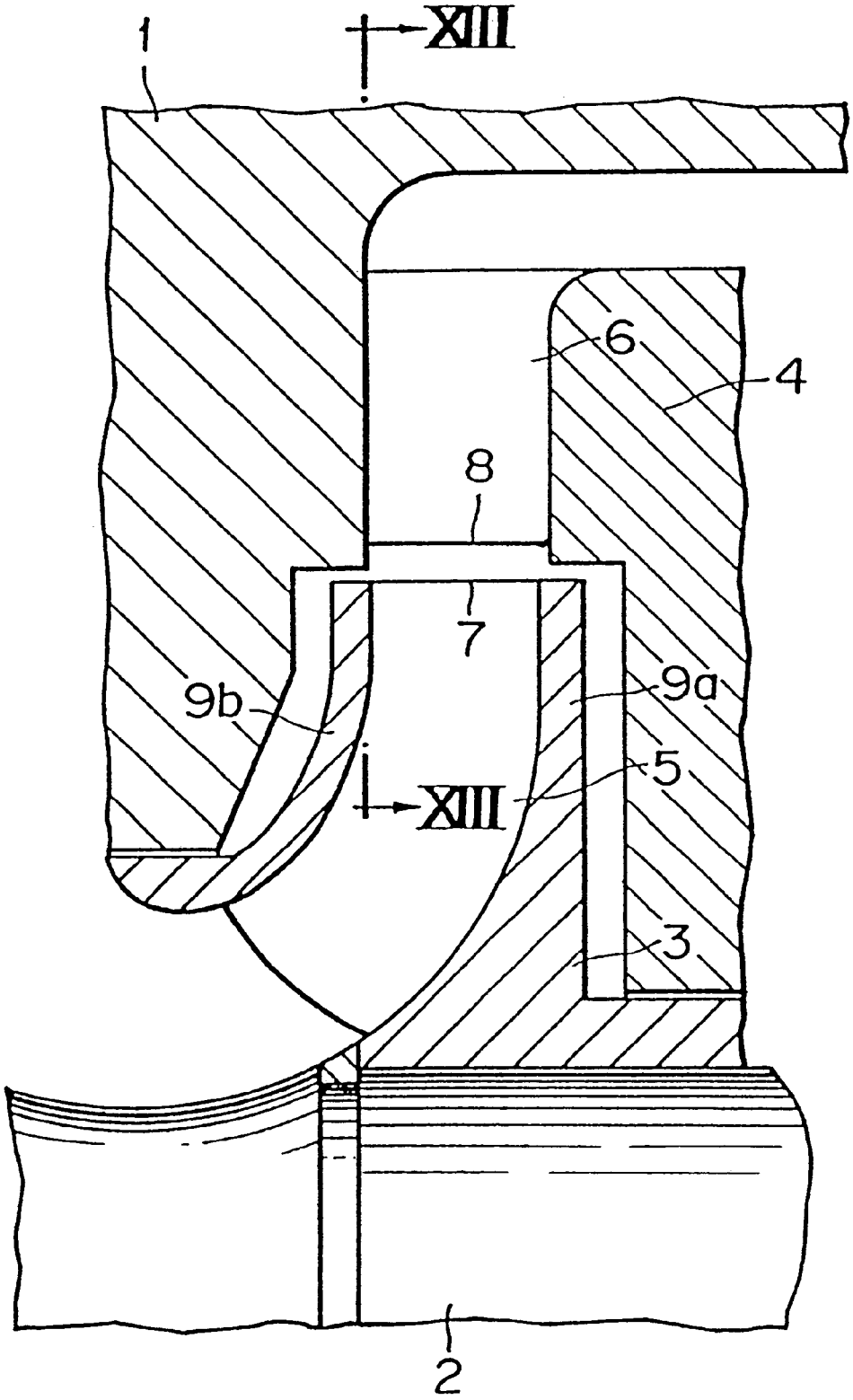
FIG. 12 is a sectional view of a diffuser pump showing an embodiment of the present invention.
Figure 13:
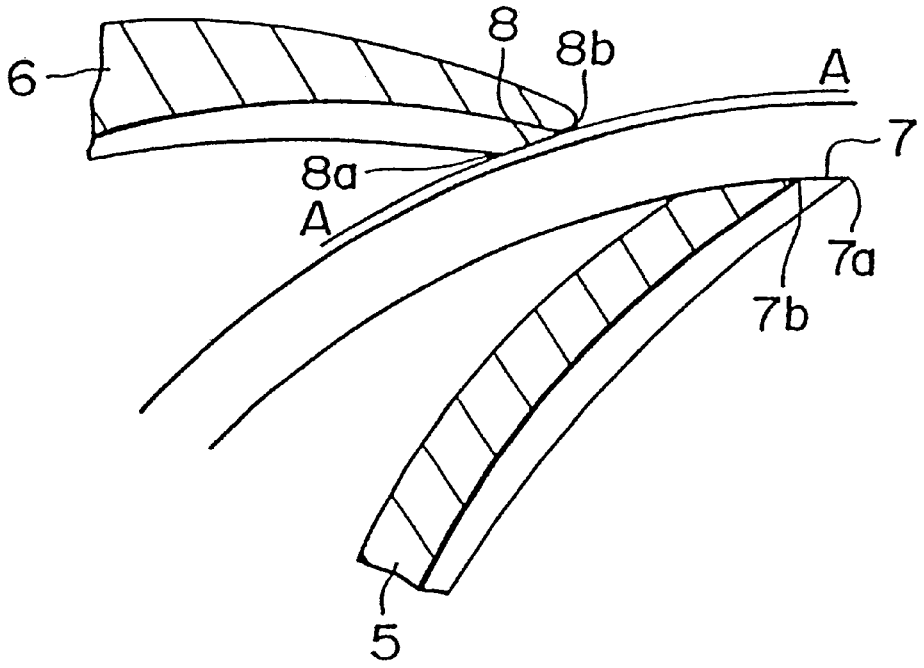
FIG. 13 is a detailed front sectional view taken along section XIII—XIII of FIG. 12 showing an embodiment of the present invention.
Figure 14:
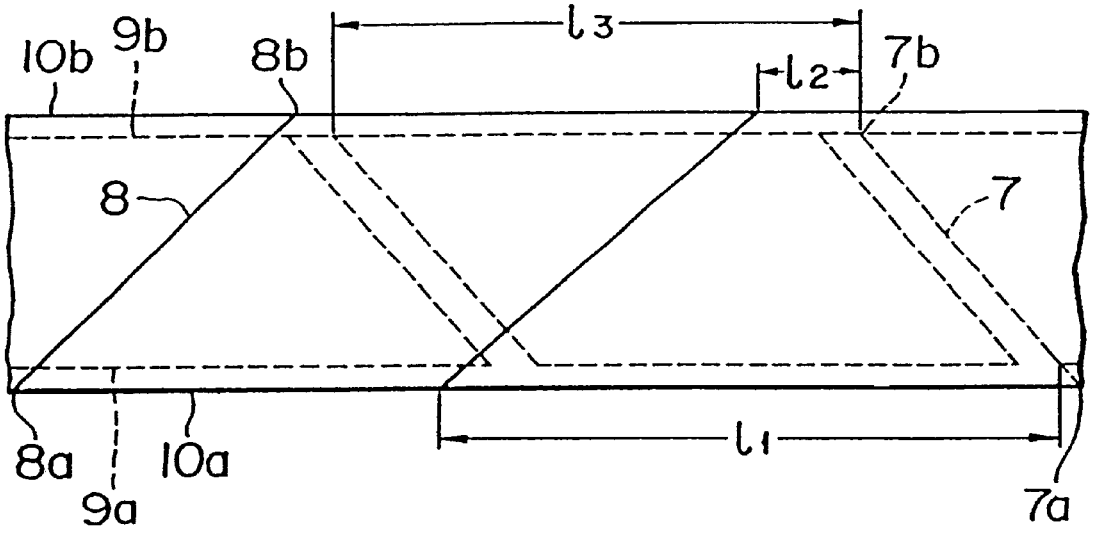
FIG. 14 is a development obtained by projecting the trailing edge of the impeller vane and the leading edge of the diffuser vane onto the A—A circular cylindrical section of FIG. 13.

Another embodiment of the present invention will now be described by way of FIG. 12. An impeller 3 is rotated about a rotating shaft 2 within a casing 1, and a diffuser 4 is fixed to the casing 1. The impeller 3 has a plurality of vanes 5 and the diffuser 4 has a plurality of vanes 6, where a trailing edge 7 of the vane 5 of the impeller 3 and a leading edge 8 of the vane 6 of the diffuser 4 are formed so that their radius is constant in the direction of axis of rotation. FIG. 13 shows in detail the vicinity of the impeller vane trailing edge 7 and the diffuser vane leading edge 8 along cross section XIII—XIII of FIG. 12. The impeller vane 5 and the diffuser vane 6 are three-dimensional shape, i.e., the peripheral position of the vanes is varied in the direction of axis of rotation. The relative position in the peripheral direction of the impeller vane trailing edge 7 and the diffuser vane leading edge 8 of FIG. 13 is shown in FIG. 14. FIG. 14 is obtained by projecting the impeller vane trailing edge 7 and the diffuser vane leading edge 8 onto a circular cylindrical development of the diffuser vane leading edge. In other words, the impeller vane trailing edge 7 and the diffuser vane leading edge 8 as seen from the center of the rotating shaft in FIG. 13 are projected onto the circular cylindrical section A—A and it is developed into a plane. As shown in FIG. 14, difference $(l_1-l_2)$ between the maximum value $l_1$ and the minimum value $l_2$ of the peripheral distance between the impeller vane trailing edge 7 and the diffuser vane leading edge 8 is made equal to the peripheral distance $l_3$ between the vane trailing edges that are next to each other in the impeller. Since pulsating flow of one wavelength occurs between the vane trailing edges that are next to each other in an impeller, phase of the pulsating flow impacting the diffuser vane leading edge 8 is shifted exactly corresponding to one wavelength along the axis of rotation; therefore, pressure pulsation applied on the diffuser vane leading edge 8 due to the pulsation and the vibrating force resulting therefrom are cancelled when integrated in the axial direction. The present invention as shown in FIG. 13 may be applied to a centrifugal pump or centrifugal compressor irrespective of whether it is of a single stage or of multistage type.

Alternatively, by setting $(l_1-l_2)$ to a part obtained by dividing $l_3$ into "n" (integer) identical parts, the phase of the pulsation flow impacting the diffuser vane leading edge 8 is shifted exactly corresponding to one wavelength of "n"th higher harmonic in the axial direction so that the vibrating forces acting on the diffuser vane leading edge 8 due to the "n"th higher harmonic component of fluctuation are cancelled when integrated in the axial direction. Especially, in a multistage fluid machine or a fluid machine having armoured type casing, vibration is transmitted through fitting portion between the stages or between the inner and outer casings so that the vibrating force due to first or "n"th dominant frequency of the above pressure pulsation largely contributes to the noise; therefore, it is important for abating the noise to design so that, of the vibrating forces due to pulsating flow, specific high order frequency components contributing to the noise are cancelled.

Figure 15:
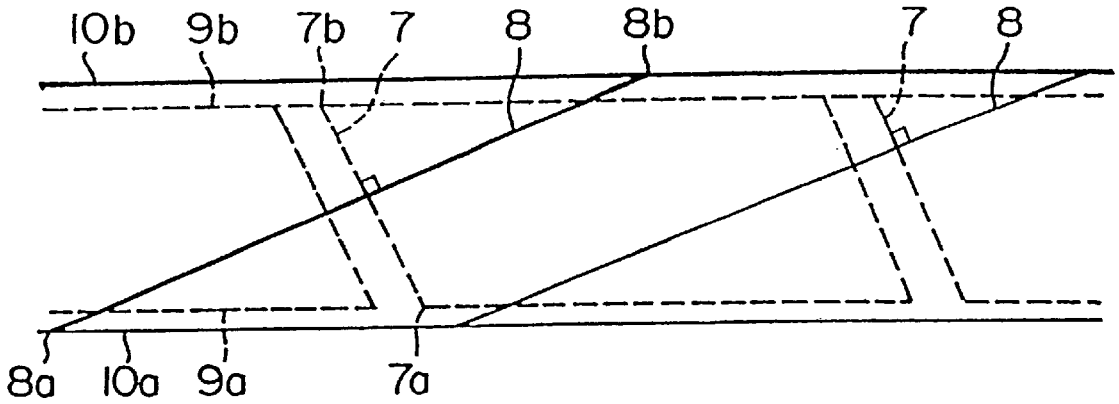
FIG. 15 is a development of another embodiment obtained by projecting the trailing edge of the impeller vane and the leading edge of the diffuser vane onto the A—A circular cylindrical section of FIG. 13.

Furthermore, as shown in FIG. 15 where the diffuser vane leading edge and the impeller vane trailing edge are projected onto a circular cylindrical development of the diffuser vane leading edge, by setting the impeller vane trailing edge 7 and the diffuser vane leading edge 8 perpendicular to each other on the circular cylindrical development, direction of the force due to pressure difference between pressure surface and suction surface of the impeller vane becomes parallel to the diffuser vane leading edge, whereby vibrating force due to such pressure difference does not act upon the diffuser vane and the noise may be abated. Frequency spectrum of the noise and of pressure fluctuation at the diffuser inlet is shown in FIG. 28 of the case where the embodiment shown in FIG. 15 is applied to a centrifugal pump. This pump has a combination of such number of vanes that the vibrating frequencies of 4NZ and 5NZ are dominant; in the case of a conventional pump shown in FIG. 27, the noise, too, is dominant at the frequency components of 4NZ, 5NZ. In the pump to which the present invention is applied, the dominance of 4NZ, 5NZ frequency components is eliminated with respect to the pressure fluctuation as shown in FIG. 28, and, as a result, 4NZ, 5NZ frequency components are remarkably reduced also in the noise so as to greatly abate the noise.

The invention shown by way of the embodiment of FIG. 15 may be applied to abate the noise in a single stage or multistage centrifugal pump or centrifugal compressor having a fitting portion between the diffuser portion and the casing or between the inner casing and the outer casing.

It should be noted that the embodiments of FIG. 14 and FIG. 15 may be achieved also by varying radius of the impeller vane trailing edge and radius of the diffuser vane leading edge in the direction of axis of rotation as shown in FIG. 2. In other words, these correspond to special cases of the embodiment shown in FIG. 4.

Figure 16:
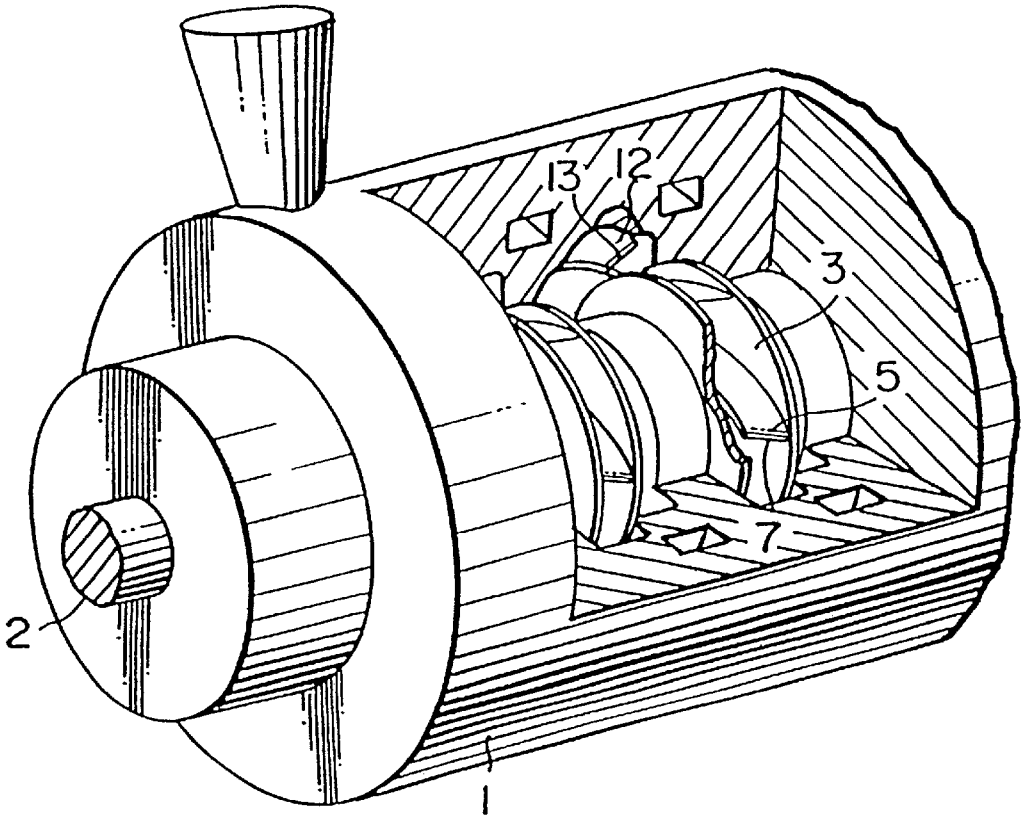
FIG. 16 is a sectional perspective view of a volute pump showing an embodiment of the present invention.
Figure 17:
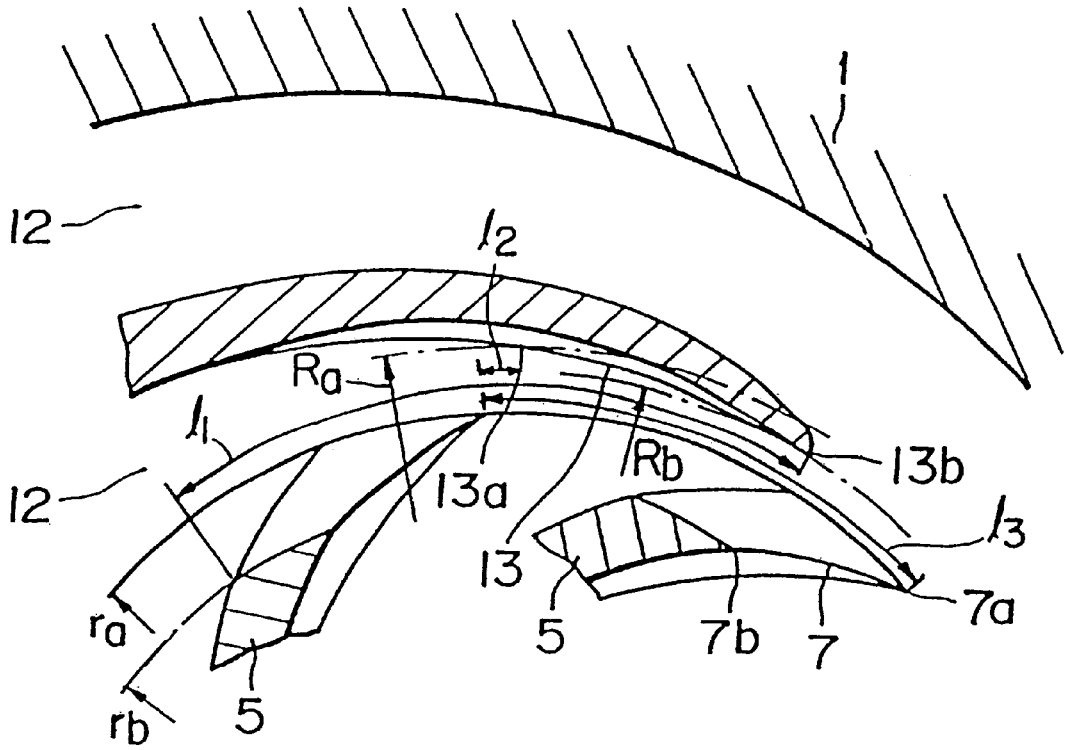
FIG. 17 is a detailed front sectional view of a volute pump showing an embodiment of the present invention.
Figure 18:
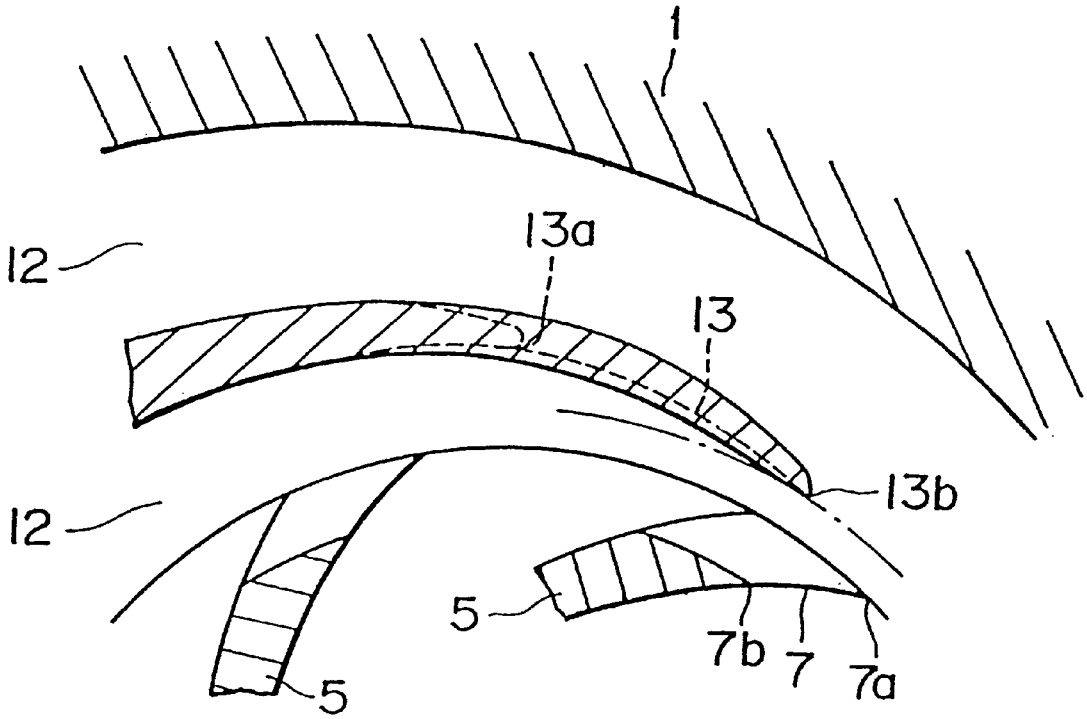
FIG. 18 is a detailed front sectional view of a volute pump showing an embodiment of the present invention.
Figure 19:
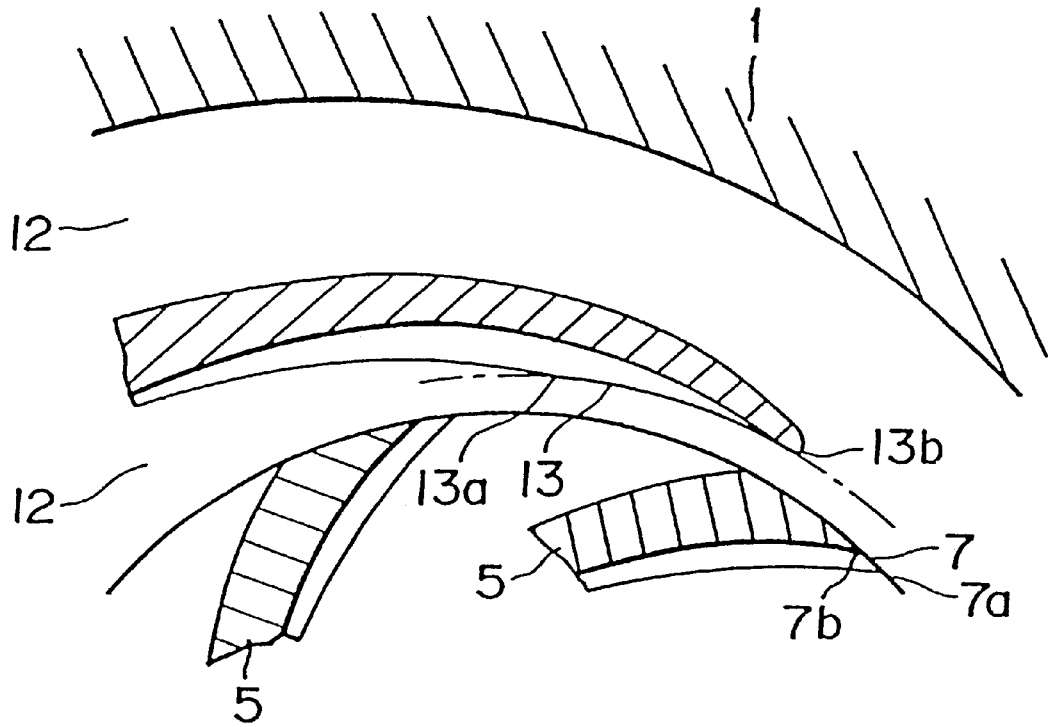
FIG. 19 is a detailed front sectional view of a volute pump showing an embodiment of the present invention.

The above invention for a centrifugal fluid machine having a diffuser on a stationary flow passage is also effective to a centrifugal fluid machine having a volute on a stationary flow passage. FIG. 16 shows an embodiment where the present invention is applied to a volute pump. Referring to FIG. 16, an impeller 3 is rotated together with a rotating shaft 2 within a casing 1, and a volute 12 is fixed to the casing 1. The impeller 3 has a plurality of vanes 5 and the volute 12 has a volute tongue 13, where radius of a vane trailing edge 7 of the impeller 3 and radius of the volute tongue 13 are varied in the direction of axis of rotation, respectively. FIG. 17 is a detailed front sectional view of the impeller and the volute shown in FIG. 16. Further, FIG. 18 shows the case where the impeller vane 5 and the volute tongue 13 are designed in two-dimensional shape. Referring to FIGS. 17 and 18, the outermost peripheral portion of the impeller vane trailing edge is 7*a* and the innermost peripheral portion thereof is 7*b;* the outermost peripheral portion of the volute tongue 13 is 13*a* and the innermost peripheral portion thereof is 13*b*. Similarly to the case of a diffuser, by varying radius of the impeller vane trailing edge 7 and radius of the volute tongue 13 in the direction of axis of rotation, the peripheral positions of the impeller vane trailing edge 7 and the volute tongue 13 are varied in the direction of axis of rotation. In an embodiment as shown in FIG. 19, radius of the impeller vane trailing edge 7 and radius of the volute tongue 13 are made constant in the direction of axis of rotation and the peripheral positions of the impeller vane trailing edge. 7 and the volute tongue 13 are varied in the direction of axis of rotation.

Figure 20:
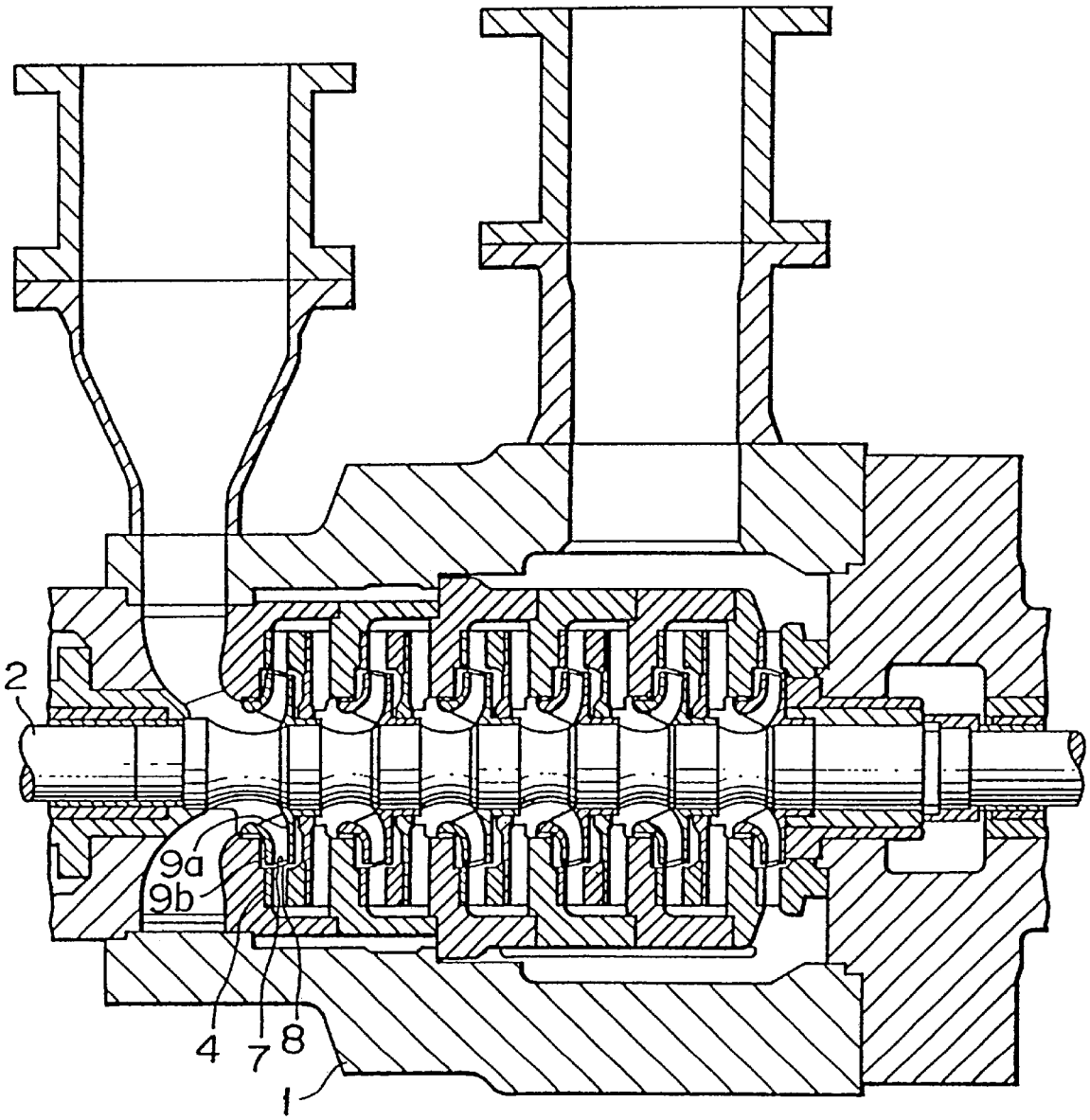
FIG. 20 is a sectional view of a barrel type multistage diffuser pump showing an embodiment of the present invention.
Figure 21:
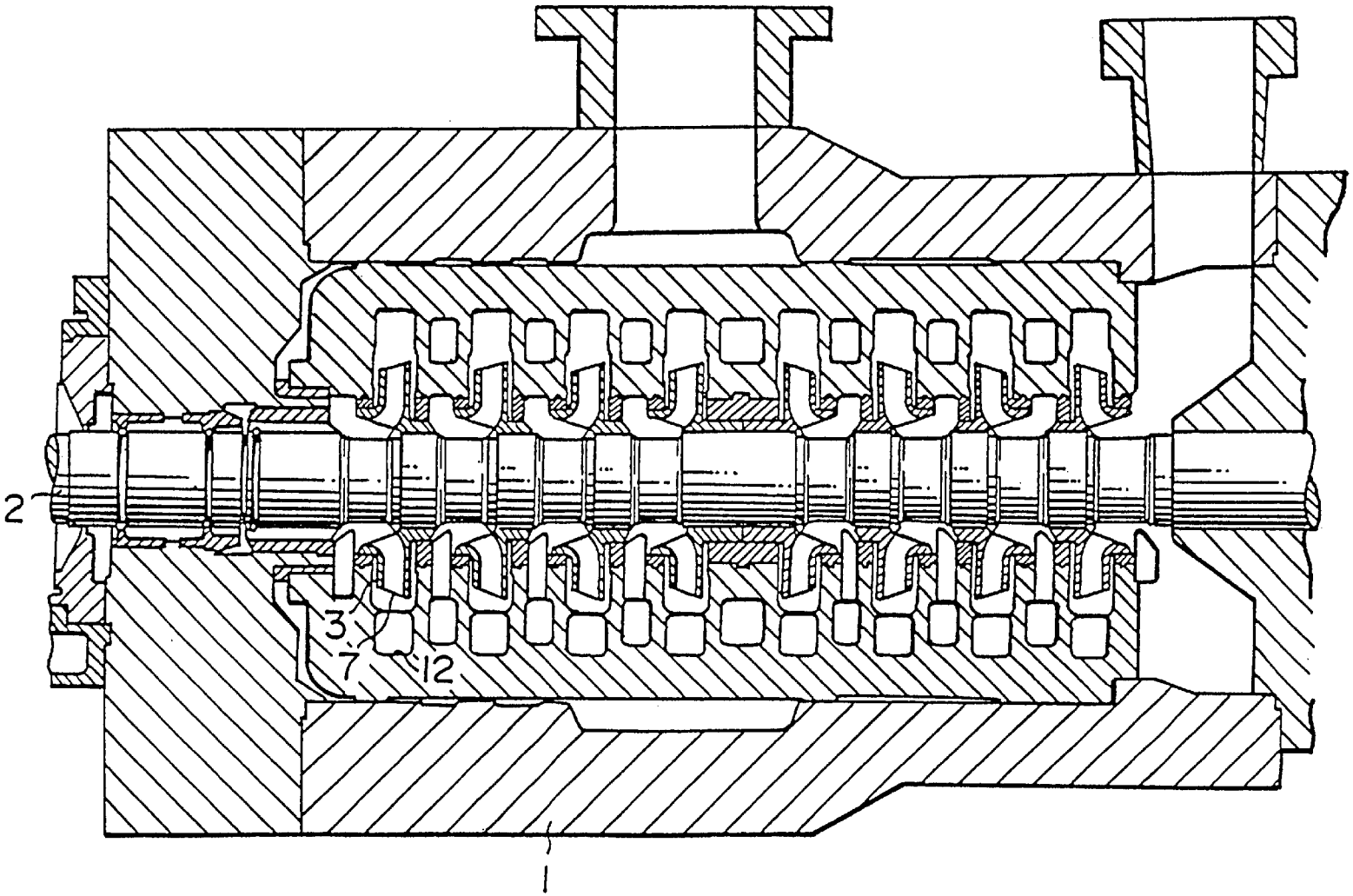
FIG. 21 is a sectional view of a multistage volute pump having a horizontally split type inner casing showing an embodiment of the present invention.
Figure 22:
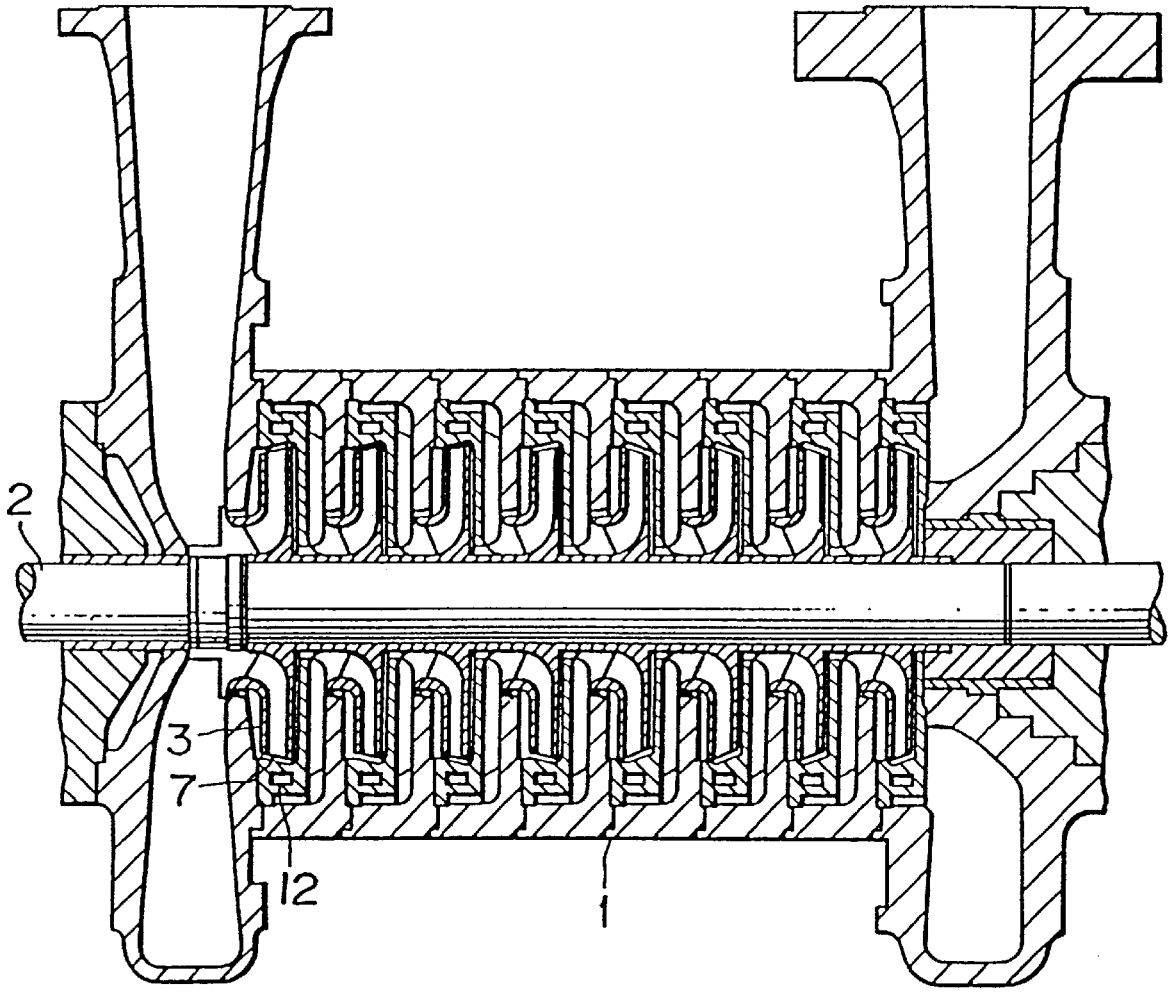
FIG. 22 is a sectional view of a sectional type multistage pump showing an embodiment of the present invention.
Figure 23:
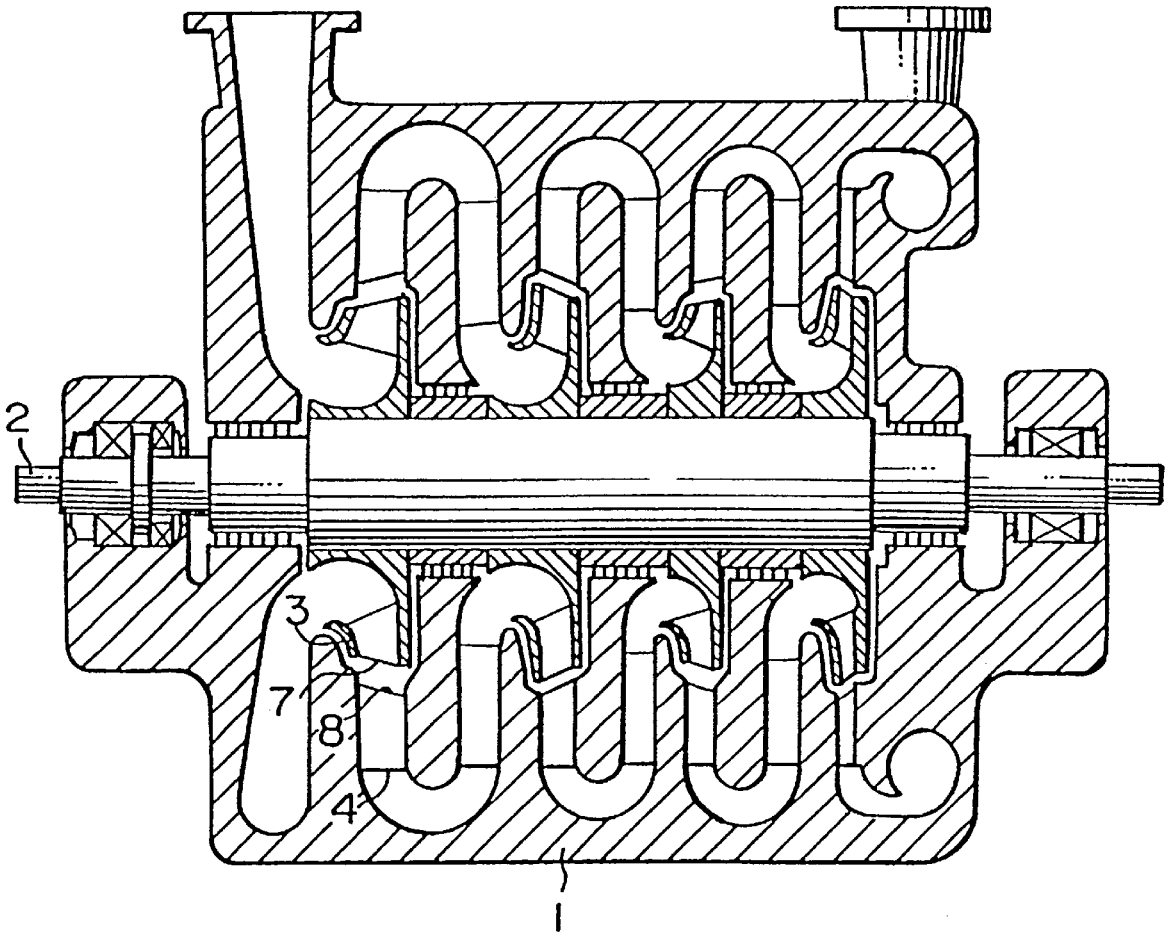
FIG. 23 is a sectional view of a horizontally split type multistage centrifugal compressor showing an embodiment of the present invention.
Figure 24:
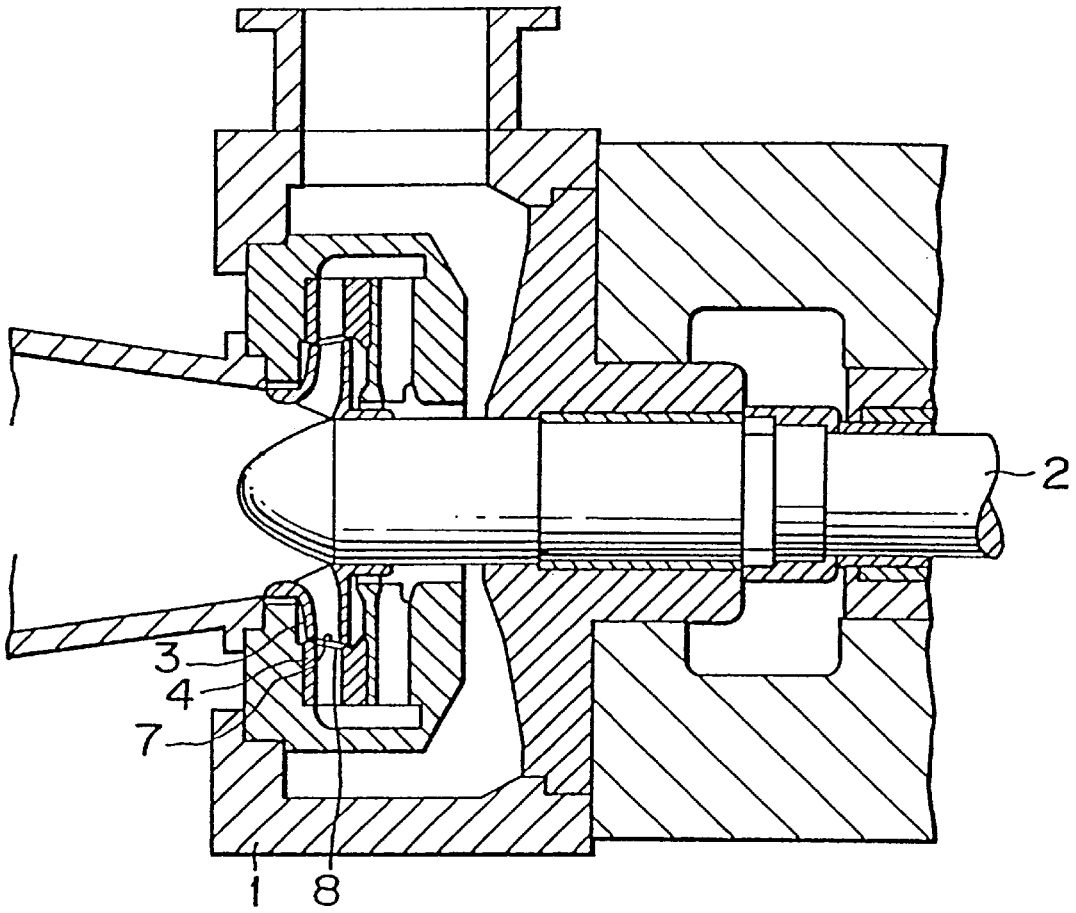
FIG. 24 is a barrel type single stage pump showing an embodiment of the present invention.
Figure 25:
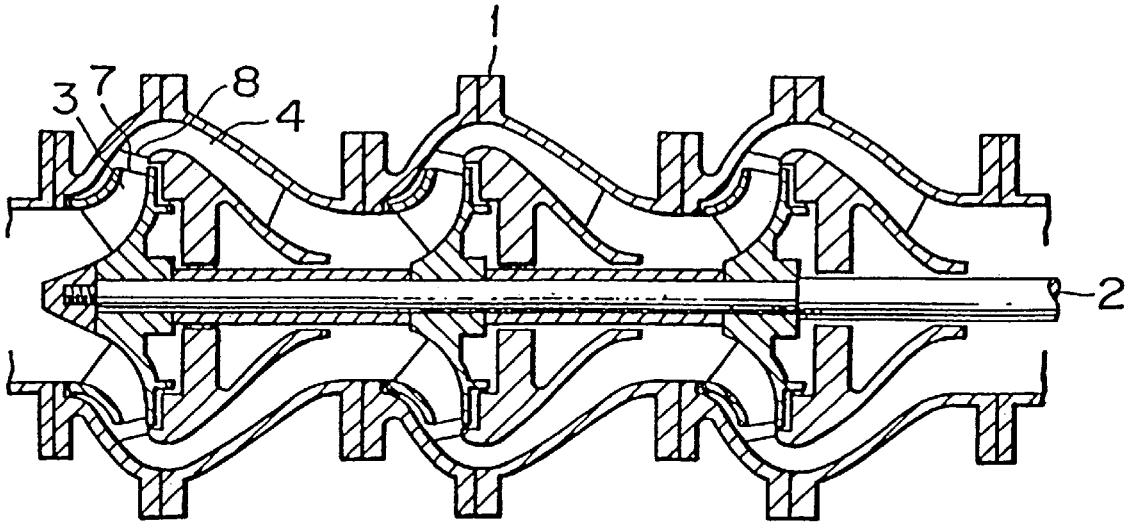
FIG. 25 is sectional view of a multistage mixed flow pump showing an embodiment of the present invention.

The present invention as described above may be applied to a fluid machine having an impeller rotating about an axis of rotation within a casing and a vaned diffuser or volute fixed to the casing; FIG. 20 being an embodiment applied to a barrel type multistage diffuser pump; FIG. 21 being an embodiment applied to a multistage volute pump having a horizontally split type inner casing; FIG. 22 being an embodiment applied to a sectional type multistage pump; FIG. 23 being an embodiment applied to a horizontally split type multistage centrifugal compressor; and FIG. 24 being an embodiment applied to a barrel type single stage pump. Further, the present invention may be applied not only to centrifugal types but also to mixed flow types. FIG. 25 shows an embodiment applied to a multistage mixed flow pump.

Furthermore, the case where multistage fluid machines are used, it is important to know how to set inclination on a meridional plane of the impeller trailing edge 7 for each stage. The reason for this is that: when, as shown in FIG. 9, the outer radius of the main shroud 9*a* and the front shroud 9*b* of the impeller and the inner radius of the front shrouds 11*a,* 11*b* of the diffuser are different, respectively, while radius ratio of the impeller and the diffuser may be smaller to control degradation in performance, the projected areas in the direction of axis of rotation of the two front shrouds are different from the conventional art and there is a problem of axial thrust due to difference in these areas. In the embodiment of FIG. 20, outer radius of the main shroud 9*a* of the impeller at all stages is smaller than outer radius of the front shroud 9*b*. In this manner, the vane length of the impeller is made uniform from the main shroud 9*a* side toward the front shroud 9*b*, and the projected area in the direction of axis of rotation of the main shroud 9*a* on the high pressure side may be made smaller in relation to the projected area of the front shroud 9*b* on the low pressure side, to thereby abate the axial thrust. In the embodiments of FIGS. 21 and 22, by reversing the inclination, on a meridional plane, of the impeller vane trailing edge between a first half of the stages and a second half of the stages, an axial thrust due to difference in the projected areas of the main shroud and the front shroud may be cancelled. In the embodiment of FIG. 23, inclination on a meridional plane of the impeller vane trailing edge is reversed between the stages that are next to each other so that an axial thrust due to difference in the projected areas of the main shroud and the front shroud may be cancelled.

Operation of the above described embodiments will now be described in further detail.

Figure 26:
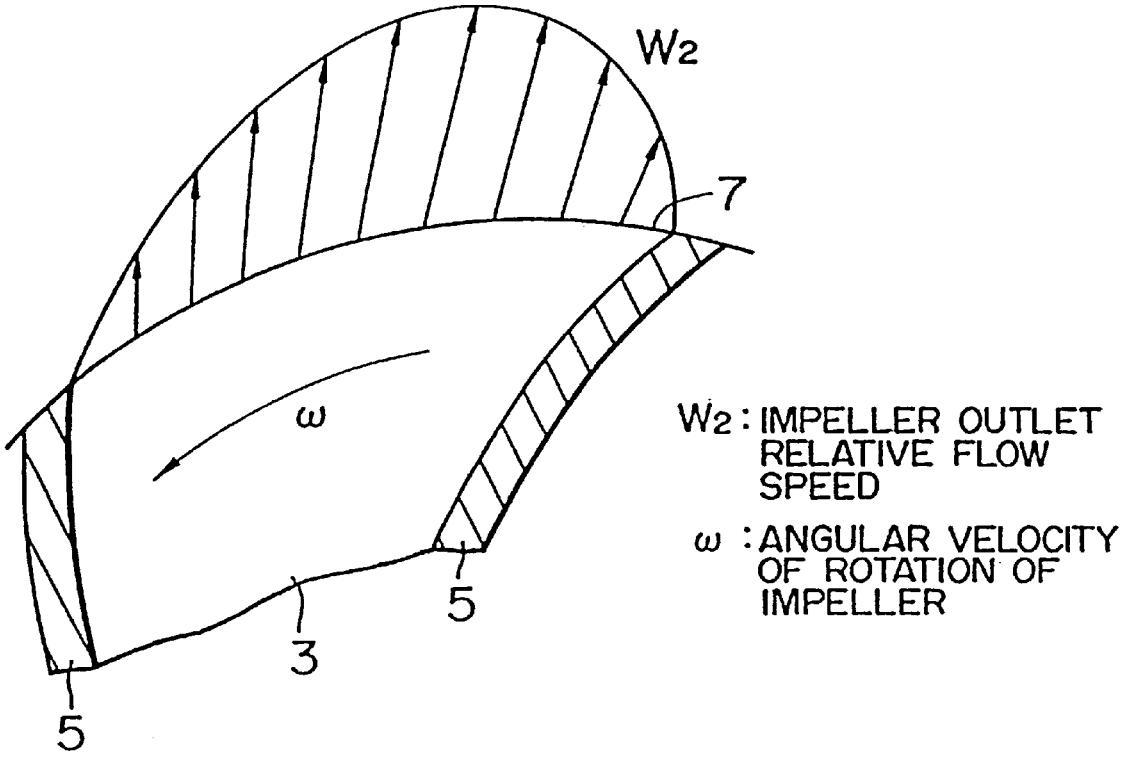
FIG. 26 illustrates flow distribution at the outlet of an impeller.

A flow $W_2$ at the outlet of the impeller forms a flow distribution that is nonuniform in the peripheral direction as shown in FIG. 26 due to the thickness of the vane 5, and secondary flow and boundary layer between the vanes. Such nonuniform pulsating flow is interfered with a diffuser vane leading edge or a volute tongue to generate a periodical pressure pulsation which causes a noise. In other cases, such pressure pulsation vibrates the diffuser and furthermore vibrates a casing or an outer casing outside thereof through a fitting portion so that the vibration is propagated into the air surrounding the pump to cause a noise.

Figure 27:
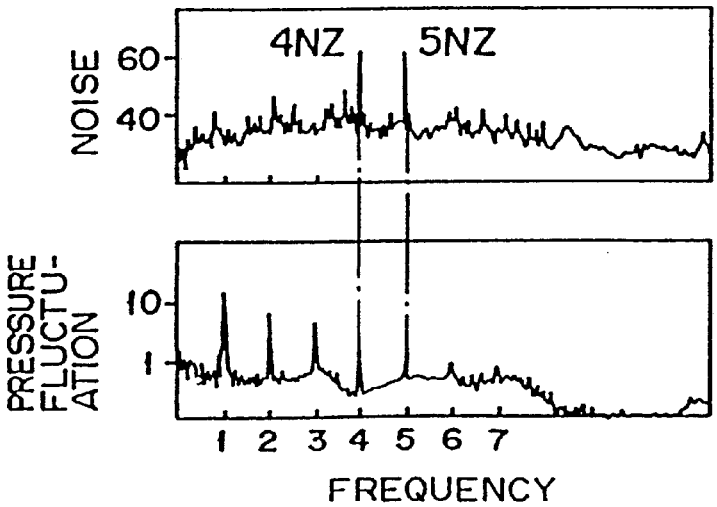
FIG. 27 shows frequency spectrum of the noise and pressure fluctuation of a pump.
Figure 28:
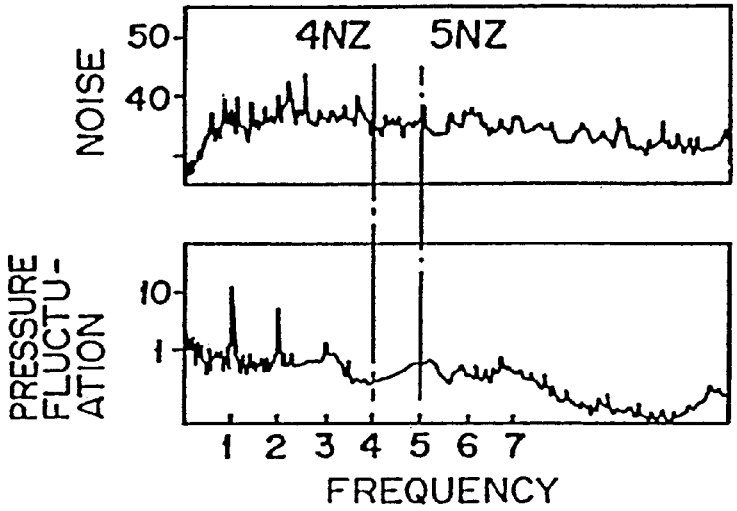
FIG. 28 shows frequency spectrum of the noise and pressure fluctuation of a pump to which the present invention is applied.

Frequency spectrum of the noise and of pressure pulsation at the diffuser inlet of a centrifugal pump is shown in FIG. 27. The frequency of the pulsating flow is the product N×Z of a rotating speed N of the impeller and number Z of the impeller vanes, the frequency on the horizontal axis being made non-dimensional by N×Z. The pressure pulsation is dominant not only at the fundamental frequency component of N×Z but also at higher harmonic components thereof. This is because the flow distribution at the impeller outlet is not of a sine wave but is strained. The noise is dominant at specific higher harmonic components of the fundamental frequency component of N×Z and the noise is not necessarily dominant at all the dominant frequency components of the above pressure pulsation. This is because, as disclosed in Japanese Patent Unexamined Publication No.60-50299, when the pulsating flow is vibrating the diffuser vane, there are some frequency components for which the vibrating force is cancelled as the entire diffuser and some other components for which it is not cancelled, due to combination of number of vanes of the impeller and the diffuser. Especially, the vibration is transmitted through a fitting portion between the stages or between the inner and outer casings in a multistage fluid machine or armoured type casing fluid machine, or, in the case of a single stage, between the diffuser and the casing, so that the vibrating force due to the above dominant frequencies largely contributes to the noise. The centrifugal pump of which the measured result is shown in FIG. 27 is constituted by a combination of the number of vanes for which the vibrating frequencies are dominant at 4NZ and 5NZ, the noise being dominant also at the frequency components of 4NZ, 5NZ.

Specifically, the vibrating force is increased as the non-uniform pulsating flow impacts the respective position in the direction of axis of rotation of the diffuser vane leading edge or volute tongue with an identical phase. Accordingly, the pressure pulsation and the vibrating force may be reduced to abate the noise by shifting the phase of the pulsating flow reaching the diffuser vane leading edge or the volute tongue, by forming an inclination on the diffuser vane leading edge or the volute tongue or by forming an inclination on the impeller vane trailing edge.

As shown in a meridional sectional view of FIG. 2 and a front view of FIG. 11 illustrating the impeller and the diffuser of a diffuser pump and in a front view of FIG. 18 illustrating a volute pump, radius of the impeller vane trailing edge 7, radius of the diffuser vane leading edge 8 and radius of the volute tongue 13 are varied in the direction of axis of rotation; thereby the peripheral positions of the impeller vane trailing edge, the diffuser vane leading edge and the volute tongue are varied in the direction of axis of rotation. In particular, in turbo fluid machines, a vane orientation is made opposite between a rotating impeller and a stationary diffuser as viewed in a flow direction. Accordingly, as shown in FIG. 2, radius of the impeller vane trailing edge, diffuser vane leading edge and the volute tongue is monotonously increased or decreased in the direction of axis of rotation and the impeller vane trailing edge, the diffuser vane leading edge and the volute tongue are inclined in the same orientation on a meridional plane; thereby, as shown in FIGS. 4 and 14 where the impeller vane trailing edge and the diffuser vane leading edge or the volute tongue are projected onto a circular cylindrical development of the diffuser leading edge portion or the volute tongue, a shift occurs in the peripheral position between the impeller vane trailing edge 7 and the diffuser vane leading edge 8 or the volute tongue 13. Accordingly, peripheral distance between the impeller vane trailing edge and the diffuser vane leading edge or the volute tongue is varied in the axial direction, whereby the fluctuating flow flowing out from the impeller vane trailing edge impacts the diffuser vane leading edge or the volute tongue with a shift in phase so as to cancel the pressure pulsation. For this reason, the vibrating force acting upon the casing is reduced and the noise is also abated. It should be noted that the change in the direction of axis of rotation of radius of the impeller vane trailing edge, radius of the diffuser vane leading edge and radius of the volute tongue is not limited to monotonous increase or decrease, and similar noise abating effect may be obtained by changing them in different ways.

The present invention may be applied to the case where the diffuser vane, volute tongue and the impeller vane are of two-dimensional shape, i.e., are designed so that the peripheral position of the vane is constant in the direction of axis of rotation (FIG. 11) and to the case where they are formed into three-dimensional shape, i.e., are designed so that the peripheral position of the vane is varied in the direction of axis of rotation (FIG. 3). Especially, since abating of noise is possible with vanes having a two-dimensional shape, diffusion joining and forming of a press steel sheet are easier and manufacturing precision of the vanes and volute may be improved. Further, since the inclinations on a meridional plane are in the same orientation, ratio of radius of the impeller vane trailing edge to radius of diffuser vane leading edge or radius of volute tongue is not largely varied in the direction of axis of rotation whereby degradation in performance is small. In other words, pressure loss due to an increased radius ratio may be reduced to control degradation in head and efficiency. Further, by setting constant the ratio of radius of the impeller vane trailing edge to the radius of the diffuser vane leading edge or radius of the volute tongue in the direction of axis of rotation, degradation in performance may be controlled to the minimum.

Other effects of the present invention will now be described by way of FIG. 14. In FIG. 14, the impeller vane trailing edge 7 and the diffuser vane leading edge 8 as seen from the center of the rotating axis in the front sectional view (FIG. 13) of the impeller and the diffuser are projected onto a circular cylindrical section A—A and are developed into a plane. The peripheral distance between the impeller vane trailing edge 7 and the diffuser vane leading edge 8 or the volute tongue 13 is varied in the direction of axis of rotation such that difference $(l_1-l_2)$ between the maximum value $l_1$ and the minimum value $l_2$ of the peripheral distance between the impeller vane trailing edge and the diffuser vane leading edge or volute tongue is identical to the peripheral distance $l_3$ between the vane trailing edges that are next to each other in the impeller. Since a pulsating flow corresponding to one wavelength is generated between the vane trailing edges that are next to each other in the impeller, phase of the pulsating flow impacting the diffuser vane leading edge or the volute tongue is shifted exactly by one wave length so that pressure pulsation and vibrating force acting upon the diffuser vane leading edge or the volute tongue due to the pulsation are cancelled when integrated in the direction of axis of rotation.

However, a rather large inclination is necessary to make the above $(l_1-l_2)$ equal to the peripheral distance $l_3$ between the vane trailing edges that are next to each other in the impeller. As described above, when the pulsating flow at the outlet of the impeller vibrates the diffuser vane leading edge or the volute tongue, only specific higher harmonic components of NZ frequency components are dominant and contribute to vibrating of the diffuser or the volute, depending on the combination of number of impeller vanes and number of diffuser vanes or number of volute tongue. Therefore, if difference $(l_1-l_2)$ between the maximum value $l_1$ and the minimum value $l_2$ of the peripheral distance between the impeller vane trailing edge and the diffuser vane leading edge or volute tongue is made equal to one of equally divided "n" (integer) parts of the peripheral distance $l_3$ between the vane trailing edges that are next to each other in the impeller, phase of the pulsating flow impacting the diffuser vane leading edge or the volute tongue is shifted exactly corresponding to one wavelength of "n"th higher harmonic in the direction of axis of rotation so that the vibrating forces applied on the diffuser vane leading edge or the volute tongue due to the "n"th higher harmonic component of the pulsation are cancelled when integrated in the direction of axis of rotation. Especially in a multistage fluid machine or a armoured type casing fluid machine, vibration is transmitted through a fitting portion between the stages of between outer and inner casings whereby vibrating forces due to the above dominant frequencies largely contribute to the noise; therefore, it is important for abatement of the noise to design in such a manner that, of the vibrating forces due to the pulsating flow, specific high order frequency components contributing to the noise are cancelled.

The above effect may also be obtained such that the impeller vane trailing edge and the diffuser vane leading edge or the volute tongue are formed into three-dimensional shape and, as shown in FIG. 13, while the respective radius of the impeller vane trailing edge and the diffuser vane leading edge or the volute tongue is fixed in the direction of axis of rotation, only their peripheral positions are changed. In other words, if difference $(l_1-l_2)$ between the maximum value $l_1$ and the minimum value $l_2$ of the peripheral distance between the impeller vane trailing edge and the diffuser vane leading edge or the volute tongue is made equal to the peripheral distance $l_3$ between the vane trailing edges that are next to each other in the impeller or to a part of "n" (integer) equally divided parts thereof, first order or "n"th order vibrating forces applied on the diffuser vane leading edge or on the volute tongue is cancelled when integrated in the axial direction.

Figure 29:
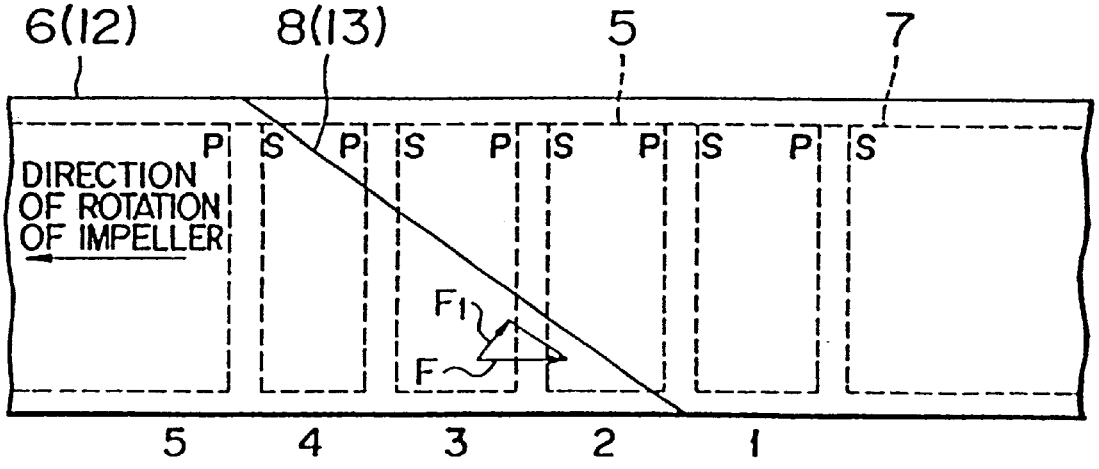
FIG. 29 illustrates the direction along which the pressure difference force between the pressure surface and the suction surface of impeller vane is acted upon.
Figure 30:
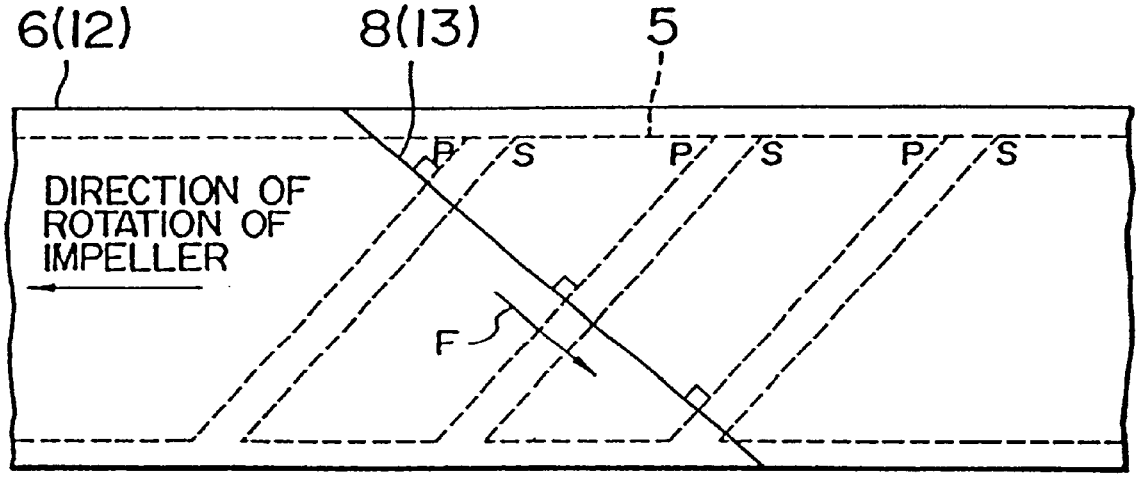
FIG. 30 illustrates the direction along which the pressure difference force between the pressure surface and the suction surface of impeller vane is acted upon according to the present invention.

Furthermore, when the diffuser vane leading edge or volute tongue and the impeller vane trailing edge are projected onto a circular cylindrical development of the diffuser vane leading edge or volute tongue, by setting the vane leading edge or the volute tongue and the vane trailing edge perpendicular to each other on the above circular cylindrical development, it is possible to abate the vibrating force due to pressure pulsation applied on the diffuser vane leading edge or volute tongue. In other words, as shown in FIG. 29, of a force F due to pressure difference between the pressure surface p and the suction surface s of the impeller vane, a component $F_1$ vertical to the diffuser vane leading edge or the volute tongue acts as a vibrating force upon the diffuser vane or the volute tongue. Specifically, the impeller vane trailing edge is displaced as indicated by 1–5 in the figure with the rotation of the impeller, so that the force $F_1$ periodically acts upon the diffuser vane or upon the volute tongue. Thus, if, as shown in FIG. 30, the impeller vane trailing edge and the diffuser vane leading edge or the volute tongue are set perpendicular to each other, the direction of force F due to pressure difference between the pressure surface p and the suction surface s of the impeller vane becomes parallel to the diffuser vane leading edge or the volute tongue so that the vibrating force does not acts upon the diffuser vane nor upon the volute tongue.

In the case where, as shown in FIG. 9, the outer diameter of the main shroud 9*a* of the impeller is made larger than the outer diameter of the front shroud 9*b* and the inner diameters of the two corresponding front shrouds of the diffuser are varied respectively in accordance with the outer diameters of the main shroud and the front shroud of the impeller, while radius ratio of the impeller to the diffuser may be made smaller to control degradation in performance, problem of an axial thrust occurs due to the fact that the projected areas in the direction of axis of rotation of the main shroud and the front shroud are different from each other. Therefore, in the case of having a multiple of stages, in addition to varying radius of the impeller vane trailing edge in the direction of axis of rotation, outer diameters of the main shroud and the front shroud are made different for at least two impellers; and, of those impellers for which the outer diameters of the main shroud and the front shroud are made different from each other, the outer diameter of the main shroud is made larger than the outer diameter of the front shroud for at least one impeller and the outer diameter of the main shroud is made smaller than the outer diameter of the front shroud for the remaining impellers; thereby, it is possible to reduce the axial thrust occurring due to difference in the projected area in the direction of axis of rotation of the main shroud and the front shroud.

As has been described, according to the present invention, noise and pressure pulsation of a centrifugal fluid machine may be optimally abated with restraining to the extent possible degradation in head and efficiency or occurrence of an axial thrust.

We claim:

1. A centrifugal fluid machine comprising:

a volute casing;

a rotating shaft within said volute casing, said rotating shaft having a longitudinally extending axis of rotation;

a plurality of centrifugal impeller vanes fixed to said rotating shaft; and at least one volute tongue fixed to said volute casing, said volute tongue cooperating with said plurality of centrifugal impeller vanes in at least one stage in each of which a trailing edge of each centrifugal impeller vane rotates about the axis of rotation and past a leading edge of a volute tongue;

wherein, within each stage, of impeller vane trailing edges, radius at the center in the direction along the axis of rotation is made larger than radii at the two ends thereof in the direction along the axis of rotation and, of a volute tongue, radius at the center in the direction along the axis of rotation is made larger than radius at the two ends thereof in the direction along the axis of rotation.

* * * * *